US012408800B1

(12) United States Patent
Millerd

(10) Patent No.: US 12,408,800 B1
(45) Date of Patent: Sep. 9, 2025

(54) METHOD AND APPARATUS FOR SECURING CONCEALABLE BODY SUPPORT

(71) Applicant: Chet Millerd, Laughlin, NV (US)

(72) Inventor: Chet Millerd, Laughlin, NV (US)

( * ) Notice: Subject to any disclaimer, the term of this patent is extended or adjusted under 35 U.S.C. 154(b) by 0 days.

(21) Appl. No.: 19/063,955

(22) Filed: Feb. 26, 2025

(51) Int. Cl.
*A47K 3/00* (2006.01)

(52) U.S. Cl.
CPC ..... *A47K 3/001* (2013.01)

(58) Field of Classification Search
CPC ..... A47K 3/001; A47K 3/003; A47K 17/022
USPC ..... 297/411.3, 411.31, 411.32; 16/419, 420, 16/444, 445, 446; 4/577.1
See application file for complete search history.

(56) References Cited

U.S. PATENT DOCUMENTS

| | | | | |
|---|---|---|---|---|
| 1,710 | A | 7/1840 | Warren, Jr. | |
| 248,790 | A | 10/1881 | Prewitt | |
| 1,008,957 | A | 11/1911 | Cox | |
| 1,074,133 | A | 9/1913 | Neustaedter | |
| 1,377,803 | A | 5/1921 | Bush | |
| 1,450,444 | A | 4/1923 | McGuire | |
| 1,663,735 | A | 3/1928 | Talbot et al. | |
| 3,010,116 | A | 11/1961 | Cowley | |
| 3,157,774 | A | 11/1964 | Moore et al. | |
| 3,467,968 | A | 9/1969 | Tatii | |
| 4,241,472 | A | 12/1980 | Iannarone | |
| 4,305,165 | A | 12/1981 | Wall, Jr. | |
| 4,680,817 | A | 7/1987 | Sloan et al. | |
| 4,777,675 | A | 10/1988 | Letner | |
| 4,796,312 | A | 1/1989 | Corlew | |
| 4,953,241 | A | 9/1990 | Williams | |
| 5,025,515 | A | 6/1991 | Rhines | |
| 5,136,735 | A | 8/1992 | Zimmerman | |
| 5,255,400 | A | 10/1993 | Sween | |
| 5,533,601 | A | 7/1996 | Wang | |
| 5,553,355 | A * | 9/1996 | Baty | A47B 95/02 16/415 |
| 5,598,590 | A | 2/1997 | Crawford et al. | |
| 5,666,677 | A | 9/1997 | Crawford et al. | |
| 5,816,374 | A | 10/1998 | Hsien | |
| 5,845,978 | A | 12/1998 | Jung | |
| 5,926,866 | A | 7/1999 | Chao | |
| 5,940,902 | A | 8/1999 | Onge et al. | |

(Continued)

FOREIGN PATENT DOCUMENTS

| | | | |
|---|---|---|---|
| CN | 114451799 | B | 8/2023 |
| GB | 2461492 | A | 1/2010 |

*Primary Examiner* — Lauren A Crane
(74) *Attorney, Agent, or Firm* — McKee, Voorhees & Sease, PLC

(57) ABSTRACT

A walk-in bathing environment is used by people who may have trouble getting in and out of standard bathtubs or showers. Rotatable grab bars are positioned in and around the bathing environments to aid in entering the environments, exiting the environments, sitting, standing, and otherwise moving relative to the bathing environment. The rotatable grab bars may be placed on the walls, top, external, or generally on and around the bathing environment such that a user can grab the one or more rotatable grab bars in order to provide support for moving relative to the bathing environment. The rotatable grab bars are connected to the environment such that they can be moved between a use and a storage configuration, such that the rotatable grab bars are extending from a portion of the housing only when desired by the user.

20 Claims, 16 Drawing Sheets

(56) References Cited

U.S. PATENT DOCUMENTS

| | | | |
|---|---|---|---|
| 5,978,983 | A | 11/1999 | Queen et al. |
| 6,088,848 | A | 7/2000 | Waterlyn |
| 6,374,460 | B1 | 4/2002 | Edevold et al. |
| 6,389,645 | B1 | 5/2002 | Polidoro |
| 6,536,078 | B2 | 3/2003 | Tsai |
| 6,637,049 | B2 | 10/2003 | Gallant |
| 6,775,861 | B1 | 8/2004 | Devereaux et al. |
| 6,843,468 | B2 | 1/2005 | Marshall et al. |
| 7,195,232 | B2 | 3/2007 | Marshall et al. |
| D548,560 | S | 8/2007 | Weinerman et al. |
| 7,594,684 | B2 | 9/2009 | Hidaka et al. |
| D625,574 | S | 10/2010 | Burns |
| 7,882,594 | B2 | 2/2011 | Ramsauer |
| 8,015,669 | B2 | 9/2011 | Huang et al. |
| 8,474,098 | B1 | 7/2013 | Yang |
| D723,900 | S | 3/2015 | Bertani |
| 9,301,652 | B2 | 4/2016 | Millerd |
| 10,123,658 | B2 | 11/2018 | Millerd |
| D900,586 | S | 11/2020 | Pille |
| D937,160 | S | 11/2021 | Ikeda et al. |
| 11,419,459 | B2 | 8/2022 | Millerd |
| D962,743 | S | 9/2022 | Adkison |
| 2004/0078887 | A1 | 4/2004 | Kuntz |
| 2004/0107486 | A1 | 6/2004 | Yoo |
| 2005/0102746 | A1 | 5/2005 | Wright et al. |
| 2007/0283527 | A1* | 12/2007 | Cheng ..... H05K 7/1494 16/114.1 |
| 2010/0275364 | A1 | 11/2010 | Torres et al. |
| 2011/0283448 | A1 | 11/2011 | Kenoyer et al. |
| 2016/0135649 | A1 | 5/2016 | Millerd |
| 2018/0084959 | A1 | 3/2018 | Hall et al. |

* cited by examiner

METHOD AND APPARATUS FOR SECURING CONCEALABLE BODY SUPPORT

TECHNICAL FIELD

The present disclosure relates generally to the use of collapsible, rotatable, hideable, and/or concealable grab bars. The grab bars may be used, for example, with walk-in bathtubs or showers, in combination with seating or furniture, or even in at least boating, airline, fitness, and home appliance industries.

BACKGROUND

It can be difficult for many to get in and out of a regular height bathtub, and even harder for the elderly and those with disabilities. For some people, it is simply impossible. Wet slippery surfaces and high walls can and do cause accidents and injuries. In fact, statistics show that most accidents in the home occur in the bathroom.

Walk-in bathtubs and showers provide environments that attempt to alleviate the issues of getting in and out of regular bathtubs. A user can simply step over the low threshold, onto the slip resistant floor of the tub, shut the door, sit down on the comfortable chair height seat, and fill the bathtub with calming water.

Furthermore, to aid in entering, exiting, or using the bathtub or shower, grab bars may be included and strategically placed in or around the bathtub or shower. These grab bars, which can be one or a plurality of bars, can be angled or otherwise oriented to provide the user with ease of sitting or standing with the least amount of effort. This is also true for entering and exiting of the tub, as the grab bars can provide a surface for stabilization.

However, as the bars extend from a surface of the bathtub or shower, they can create obstacles or obstructions when not in use. The bars extend away from the bathtub or shower surface and can injure a user if a fall or slip were to occur.

Therefore, there is a need in the art for a grab bar that can be selectively provided for use when needed, but that can be moved to a non-use configuration in a user-friendly manner in which the grab bar is out of a user's way.

SUMMARY

The following objects, features, advantages, aspects, and/or embodiments are not exhaustive and do not limit the overall disclosure. No single embodiment need provide each and every object, feature, or advantage. Any of the objects, features, advantages, aspects, and/or embodiments disclosed herein can be integrated with one another, either in full or in part.

It is a primary object, feature, or advantage of the present invention to improve on or overcome the deficiencies in the art.

It is still yet a further object, feature, or advantage of the present invention to provide a grab bar that can be locked into place during use or when the grab bar is in the non-use configuration, thereby preventing injury to a user.

It is still yet a further object, feature, or advantage of the present invention to provide a grab bar that is cost effective.

It is still yet a further object, feature, or advantage of the present invention to provide a grab bar that is reliable and durable and has a long usable life.

It is still yet a further object, feature, or advantage of the present invention to provide a grab bar that is easily manufactured, assembled, installed, disassembled, and uninstalled.

It is still yet a further object, feature, or advantage of the present invention to provide an apparatus that is aesthetically pleasing.

It is still yet a further object, feature, or advantage of the present invention to incorporate the grab bar into a system which includes a walk-in bathtub and/or a shower.

It is still yet a further object, feature, or advantage of the present invention to provide methods of using, manufacturing, and installing a grab bar accomplishing some or all of the previously stated objectives.

The present disclosure is directed generally towards one or more grab bars for use with walk-in bathtubs and/or showers. The bathtubs and/or showers may be referred to as a bathing environment of the walk-in sort. A walk-in bathing environment is used by people who may have trouble getting in and out of standard bathtubs or showers. Therefore, the bathing environments of the walk-in sort may include a door or other threshold in which a user does not need to step over in order to enter the tub or other environment.

Grab bars are positioned in and around the bathing environments to aid in entering the environments, exiting the environments, sitting, standing, and otherwise moving relative to the bathing environment. The grab bars may be placed on the walls, top, external, or generally on and around the bathing environment such that a user can grab the one or more grab bars in order to provide support for moving relative to the bathing environment.

The present disclosure contemplates the use of a collapsible type grab bar or a plurality of collapsible type grab bars for use with a walk-in bathing environment. The collapsible grab bars may take many forms, including but not limited to, sliding grab bars, folding grab bars, or the like. Sliding grab bars are movable to extend in and out of a grab bar housing in a manner such that the grab bars move between a useable and non-use configuration. When in a use configuration, the grab bars extend generally away from the housing such that a user is able to grab a portion of the bar to provide support, such as for standing up from a seat of the bathing environment or for entering or exiting through a door of the bathing environment. In a non-use configuration, the bar may be slid such that a majority or substantial portion of the bar is at or below the top threshold of the grab bar housing such that the grab bar is hidden away. In such a configuration, the grab bar will not extend to an area within or outside of the walk-in bathing environment to aid in mitigating the amount of surfaces for getting in the way of a user of the bathing environment.

Other varieties of grab bars include folding type grab bars wherein the grab bar is foldable between a use and a non-use configuration. The grab bar can be rotated about the grab bar housing generally between a 90° angle of movement to place the grab bar in a use or non-use configuration. For example, in a non-use configuration, the grab bar can be housed substantially within a recess of the grab bar housing such that it does not extend outwardly therefrom. However, in a use configuration, the grab bar can be rotated and locked in place such that it is rotated approximately 90° from the non-use configuration to allow a use to be able to grab a bar and use said bar in moving relative to the bathing environment. For example, when a user is done with their bathing and wishes to exit the bathing environment, they may fold down one or more grab bars such that the user can pull himself or herself up and provide a more stabilized surface for exiting the bathing environment.

According to some aspects of the present disclosure, a grab bar assembly including a housing which includes both of a recessed portion and a flange portion, and the grab bar assembly further includes a central pivot pin positioned in the recessed portion. Further, the grab bar assembly includes a handle comprising a grabbing portion, a handle base, a first lock hole, and a second lock hole, wherein the handle is rotatable around the central pivot pin between a use configuration and a storage configuration. Further still, the grab bar assembly includes a button on the flange portion extending into the recessed portion and positioned on a first side of the handle, the button including a pair of button slides. Moreover the grab bar assembly includes a bolt extending through the button, through the recessed portion, and into either of the first lock hole or the second lock hole; wherein the bolt includes a pair of bolt slides in sliding communication with the pair of button slides so as to be capable of converting a first translational motion into a second translational motion orthogonal to the first translational motion when the pair of button slides interface with the pair of bolt slides.

According to some additional aspects of the present disclosure, the central pivot pin passes through the recessed portion, the handle base, and the recessed portion again.

According to some additional aspects of the present disclosure, an end of the central pivot pin is male-threaded and a central pivot pin aperture receiving the central pivot pin is female-threaded.

According to some additional aspects of the present disclosure, the grab bar assembly further includes a spring pin to bias the bolt towards the handle, wherein the spring pin extends through the recessed portion and into the bolt.

According to some additional aspects of the present disclosure, the handle includes a catch tab for preventing the rotatable body support from rotating more than 180°.

According to some additional aspects of the present disclosure, the housing includes a first catch indent positioned at a second side of the handle, wherein the housing includes a second catch indent positioned at the first side of the handle, and wherein when the handle rotates from the use configuration to the storage configuration a first side of the catch tab interfaces with the first catch indent and a second side of the catch tab interfaces with the second catch indent.

According to some additional aspects of the present disclosure, the grab bar assembly further includes a canyon in the recessed portion to allow for a full 180° range of motion for the handle.

According to some additional aspects of the present disclosure, the button further includes a button top substantially flush with the flange, a button bottom opposite the button top, and a pair of button columns connecting the button bottom and the button top.

According to some additional aspects of the present disclosure, the grab bar assembly further includes a fitted button aperture to receive and stabilize the button bottom.

According to some additional aspects of the present disclosure, the bolt includes a bolt head and a bolt tail opposite the bolt head for inserting into the handle, wherein the bolt head is wider than the bolt tail.

According to some additional aspects of the present disclosure, the bolt tail extends through the pair of button columns, the button top, and the button bottom, but the bolt head cannot extend through the pair of button columns, the button top, and the button bottom.

According to some additional aspects of the present disclosure, the button bottom prevents the button top from extending further than the flange.

According to some additional aspects of the present disclosure, the pair of button slides extend from the pair of button columns.

According to some additional aspects of the present disclosure, the first lock hole and the second lock hole are not aligned across the handle base.

According to some additional aspects of the present disclosure, the grab bar assembly further includes mounting apertures positioned at distal ends of the flange.

According to some additional aspects of the present disclosure, the spring pin extends through a button aperture of the grab bar assembly.

According to some additional aspects of the present disclosure, the handle base is substantially flush with the flange when in the storage position.

According to some additional aspects of the present disclosure, the housing provides stability for each of the handle, the button, the bolt, the spring pin, and the central pivot pin.

According to some other aspects of the present disclosure, a grab bar assembly built into a surface comprising: a grab bar housing including a recessed portion and a flange portion; a central pivot pin positioned in the recessed portion; a handle comprising a grabbing portion, a handle base, a first lock hole, and a second lock hole, wherein the handle is rotatable around the central pivot pin between a use configuration and a storage configuration; a button on the flange portion extending into the recessed portion and positioned on a first side of the handle, the button including a button slide; and a bolt extending into either of the first lock hole or the second lock hole, the bolt including a bolt slide for interfacing with the button slide; wherein in the storage configuration the grabbing portion is concealed within a wall of a structure, said structure being a building, a seat, or an appliance; wherein the grabbing portion is at or below the surface when in the storage configuration; and wherein the grabbing portion extends outward at least partially from the surface in the use configuration.

According to some other aspects of the present disclosure, a method of concealing and revealing a handle, comprising: housing the handle comprising a grabbing portion, a handle base, and a central pivot pin aperture with a central pivot pin extending therethrough within a housing having a recessed portion and a flange, said recessed portion both receiving and supporting the central pivot pin and said flange extending outwardly of the recessed portion and having a thickness less than a depth of the recessed portion; allowing the rotatable body support to rotate approximately 180° around the central pivot pin between a use configuration and a storage configuration, wherein in the storage configuration the housing conceals the grabbing portion within a surface of a building, a seat, or an appliance; and pressing a button positioned on the flange to lock or unlock the handle to allow for rotation from the use configuration to the storage configuration; wherein the grab bar housing is mounted to the building, the seat, or the appliance such that at least a portion of the grab bar housing is flush with the surface.

The preceding provides a list of aspects or embodiments disclosed herein and does not limit the overall disclosure. It is contemplated that any of the embodiments disclosed herein can be combined with other embodiments, either in full or partially, as would be understood from reading the disclosure. These and/or other objects, features, advantages, aspects, and/or embodiments will become apparent to those skilled in the art after reviewing the following brief and detailed descriptions of the drawings. The present disclosure encompasses (a) combinations of disclosed aspects and/or embodiments and/or (b) reasonable modifications not shown or described.

BRIEF DESCRIPTION OF THE DRAWINGS

Several embodiments in which the present disclosure can be practiced are illustrated and described in detail, wherein like reference characters represent like components throughout the several views. The drawings are presented for exemplary purposes and may not be to scale unless otherwise indicated.

An artisan of ordinary skill in the art need not view, within isolated figure(s), the near infinite distinct combinations of features described in the following detailed description to facilitate an understanding of the present disclosure.

DETAILED DESCRIPTION

The following definitions and introductory matters are provided to facilitate an understanding of the present invention. Unless defined otherwise, all technical and scientific terms used herein have the same meaning as commonly understood by one of ordinary skill in the art to which embodiments of the present invention pertain.

The terms "a," "an," and "the" include plural referents unless context clearly indicates otherwise. Similarly, the word "of" is intended to include "and" unless context clearly indicate otherwise. The word "or" means any one member of a particular list and also includes any combination of members of that list.

The terms "invention" or "present invention" as used herein are not intended to refer to any single embodiment of the particular invention but encompass all possible embodiments as described in the specification and the claims.

Terms such as first, second, vertical, horizontal, top, bottom, upper, lower, front, rear, end, sides, concave, convex, and the like, are referenced according to the views presented. These terms are used only for purposes of description and are not limiting unless these terms are expressly included in the claims. Orientation of an object or a combination of objects may change without departing from the scope of the invention.

The following embodiments are described in sufficient detail to enable those skilled in the art to practice the invention however other embodiments may be utilized. Mechanical, procedural, and other changes may be made without departing from the spirit and scope of the invention. Accordingly, the scope of the invention is defined only by the appended claims, along with the full scope of equivalents to which such claims are entitled.

Figure 1:
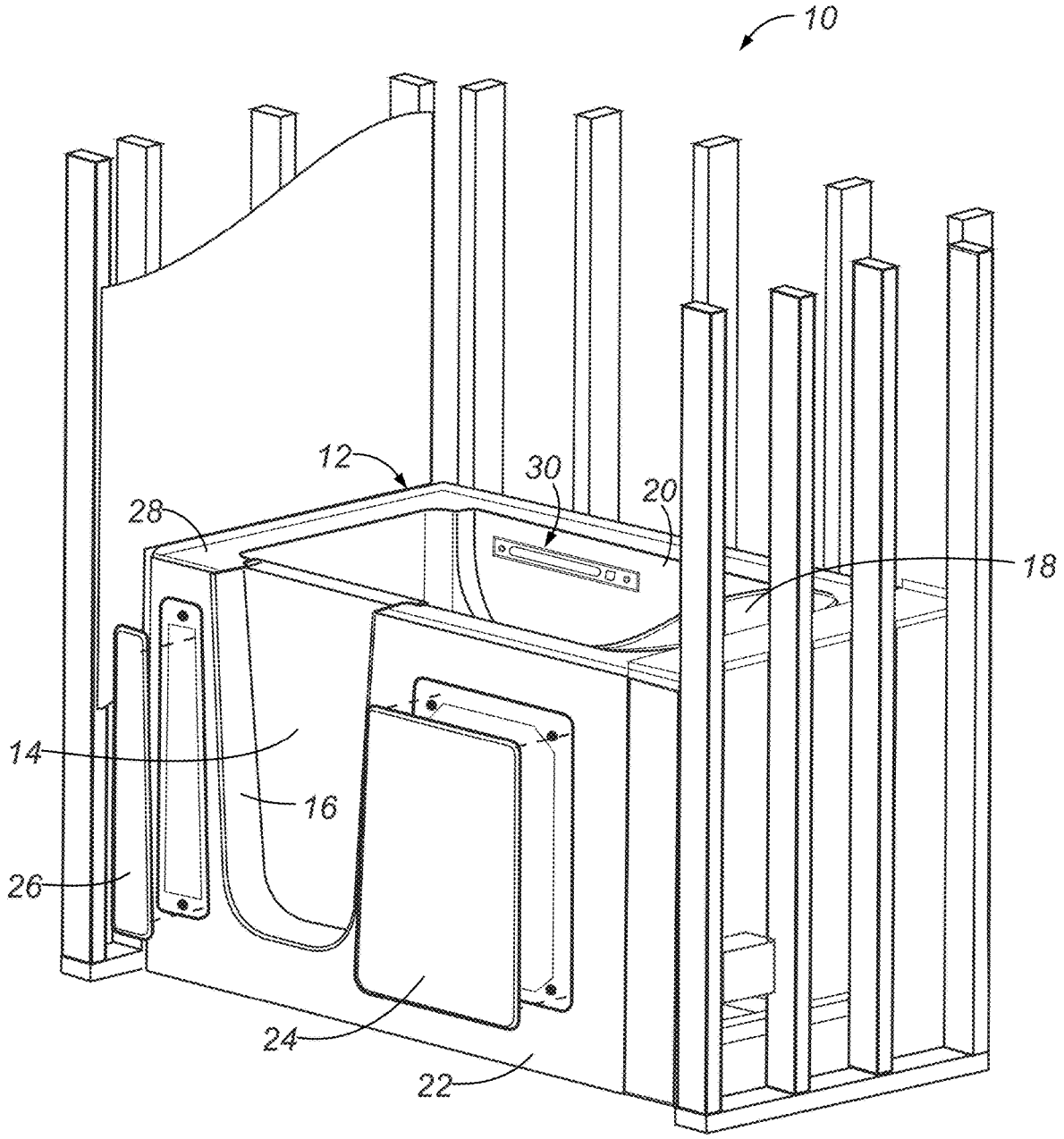
FIG. 1 is a perspective view of a walk-in bathtub.

FIG. 1 shows a perspective view of a bathing environment 10, which is shown to be a walk-in type bathtub. While a bathtub is shown as the bathing environment 10, it should be appreciated that other types of bathing environments, including other types of bathtubs, showers, saunas, or other environments are included to be used with the aspects of the invention. The walk-in bathtub 10 includes a housing 12. The housing 12 comprises a fiberglass shell that is made of sheets of fiberglass lying on top of one another and finished with a gel coating. An entrance 16 is formed within the housing 12 and is closed off or accessed by a door 14 positioned at the entrance. The door 14 also comprises a fiberglass material and is hingeably attached to the housing 12 at the entrance 16 such that it is openable and closable. The door 14 will include a seal (not shown) to ensure that water added to the interior of the housing 12 does not leak or otherwise disperse through the entrance 16 when the door is closed, such as shown in FIG. 1. Further aspects of the housing 12 include an interior wall 20 and an exterior wall 22, and a bathtub top surface 28 extending generally between the interior 20 and exterior 22 walls. As shown in the figure, access panels 24, 26 may be included on the external or internal walls to provide access to the interior of the housing walls such that pipes, electronics, or other internal components of the bathtub 10 can be accessed. Still other components such as jets, control panels, user interfaces, faucets, showerheads, curtains, and the like may be included with the bathing environments.

Figure 2:
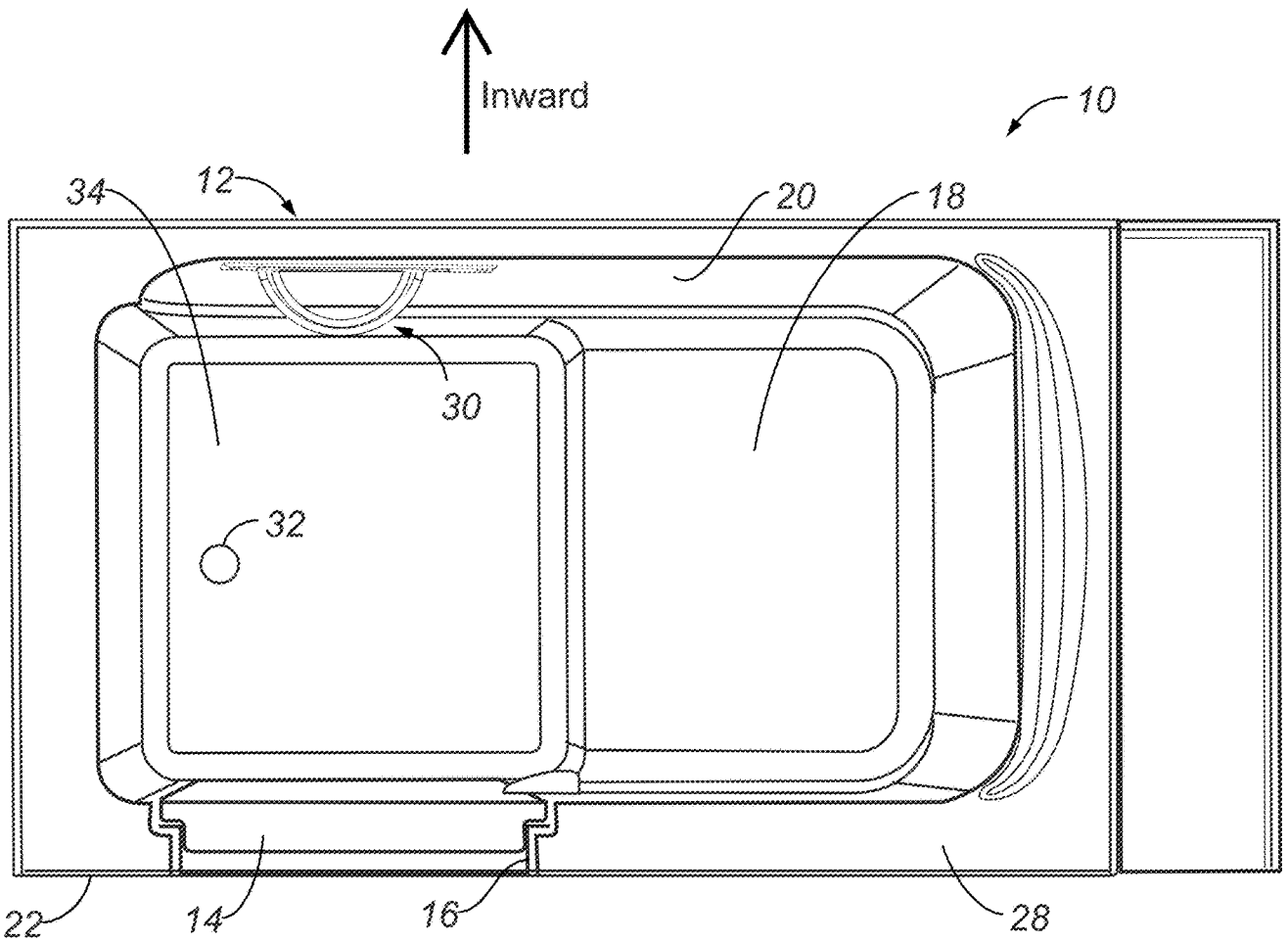
FIG. 2 is a top plan view of a walk-in bathtub.

FIG. 2 shows a generally top planar view of a bathtub as similar to that shown in FIG. 1. The bathtub 10 shown in FIG. 2 includes many of the same components thereof, and includes a view of a top surface 28 generally connecting the interior wall 20 and exterior wall 22 of the housing 12. Additional components shown in FIG. 2 include a seat 18, a drain 32, and a floor 34 of the housing 12. The floor and/or seat may include a non-slip finish such that the finish will mitigate slippage by a user when the bathtub includes water added therein. Additional aspects may include a seat cushion on or around the seat 18 to provide comfort for the user of the bathtub 10. Furthermore, as is shown in FIGS. 1 and 2, a grab bar 30 is included at the interior wall 20 of the housing 12. The grab bar 30 shown in the figures is a substantially U-shaped member comprising a rigid material, such as metal, plastic, ceramic, or the like. In FIG. 1 the grab bar 30 is placed in a storage configuration, so as to produce an effect of being substantially flush with the interior wall 20. In FIG. 2, the grab bar 30 is in a use configuration and as such extends outwardly from the interior wall 20. As shown in FIG. 2 and additional figures that follow, there is an arrow pointing in an inward direction, wherein the storage configuration for the grab bar 30 will be such that a grabbing portion of the grab bar 30 is positioned inward whereas the use configuration (as of that shown in FIG. 2) is positioned opposite of the inward arrow.

The grab bar 30 is angled on the interior wall of the housing 12, to aid in stability for a user. For example, the grab bar 30 may be ergonomically angled to provide the user of the bathtub 10 in ease of sitting or standing with the least amount of effort. Furthermore, while it is not shown, additional grab bars can be positioned throughout the interior and/or exterior of the housing 12, such as in or on the interior wall 20, or the bars can be added as well as to the top surface 28 of the bathtub or shower or other bathing environment. Additional grab bars can provide additional stability when entering or exiting the walk-in type bathtub.

Figure 3A:
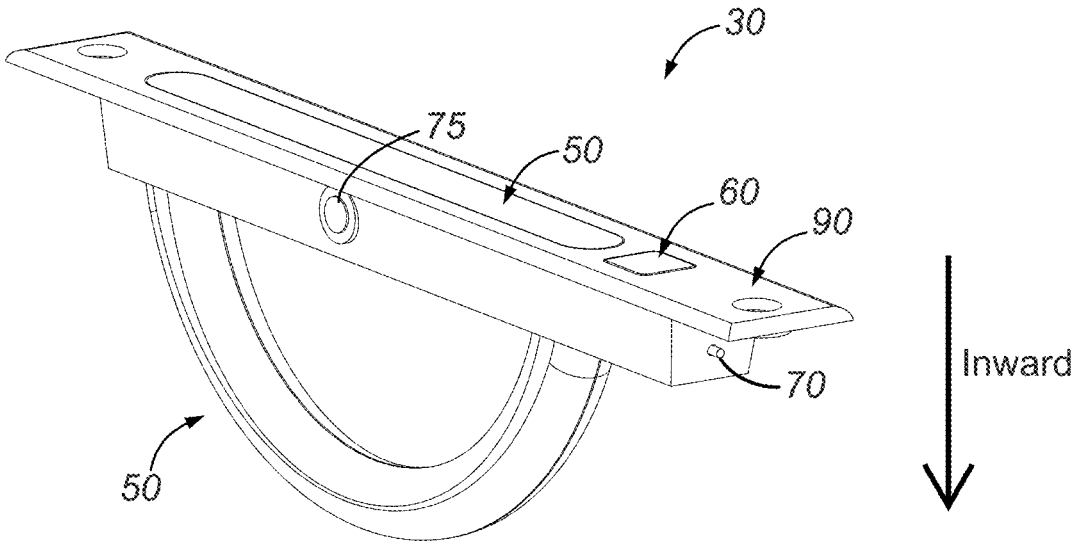
FIG. 3A is a perspective view of a grab bar in a non-use configuration according to some aspects of the invention.
Figure 3B:
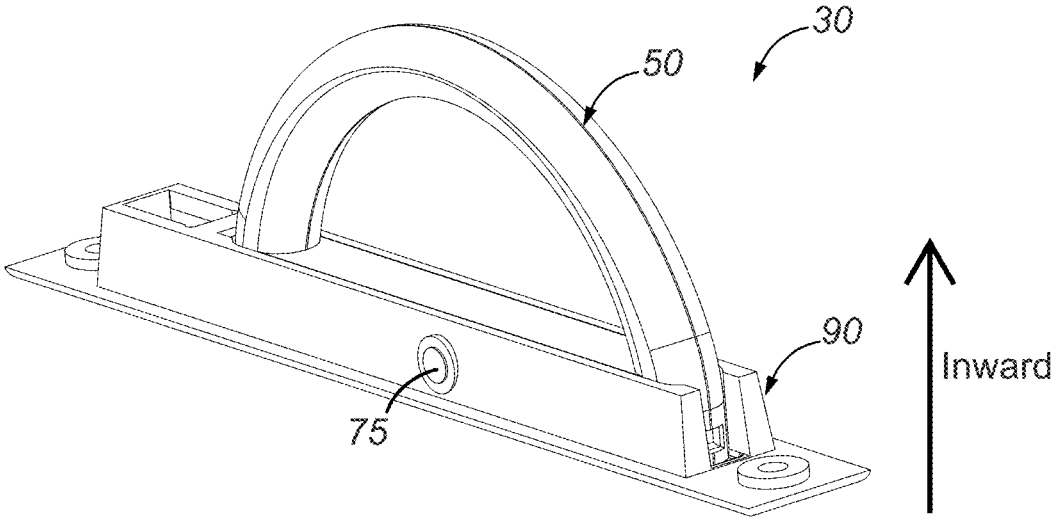
FIG. 3B is an additional perspective view of a grab bar in a non-use configuration according to some aspects of the invention.

FIGS. 3A-3B show a grab bar assembly 30. The grab bar assembly 30 may include a handle 50, a button 60, a spring pin 70, a central pivot pin 75, a bolt 80 (shown in later figures), and a housing 90.

The grab bar assembly 30 is configured such that the handle 50 may be grabbed for stability when it is in a use configuration (as shown in FIG. 2). The grab bar 30 may alternatively be placed in a storage configuration (as shown in FIG. 1 and FIGS. 3A-3B). The handle 50 is rotatably attached to the housing 90 which houses the button 60, the spring pin 70, the central pivot pin 75, and the bolt 80. As such, the handle 50 is in rotatable communication with the housing 90. The handle 50 is locked when in either of the use configuration or the storage configuration and can be unlocked by pressing the button 60 inward. By pressing the button 60 which is positioned on a viewable side of the housing 90, the button 60 will interact with both of the spring pin 70 and the bolt 80. When this happens, the handle 50 becomes unlocked, and the handle 50 may rotate around the central pivot pin 75 so as to transition between the use configuration and the storage configuration. The central pivot pin 75 is positioned transverse to the housing so as to allow the rotating handle 50 to be orthogonal or perpendicular to the housing 90 when in the use configuration, given that the central pivot pin 75 is a center point of rotation for the handle 50.

FIGS. 4-22B will elaborate on details of the handle 50, the button 60, the spring pin 70, the central pivot pin 75, the bolt 80, and the housing 90, and the remaining figures will return to explaining the grab bar 30 in greater detail after each of these components are explained. Further, FIGS. 3A, 3B, 4, 5, 6A, 6B, 7A, 7B, 19A, 19B, 20, 21A, 22B, 22A, 22B, 23A-C, 24A, 24B, 25A, and 25B are all scaled 1:2 in inches for the grab bar 30. Further, FIGS. 8-17B are all scaled 3:1 in inches for the grab bar 30.

Figure 4:
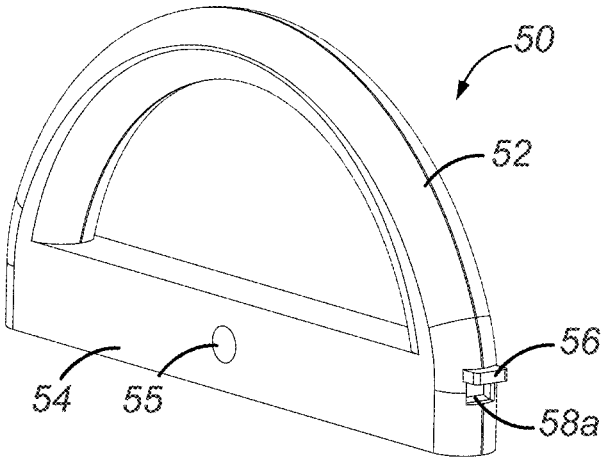
FIG. 4 is a perspective view of a handle that is used with the grab bar of FIGS. 3A-3B.
Figure 5:
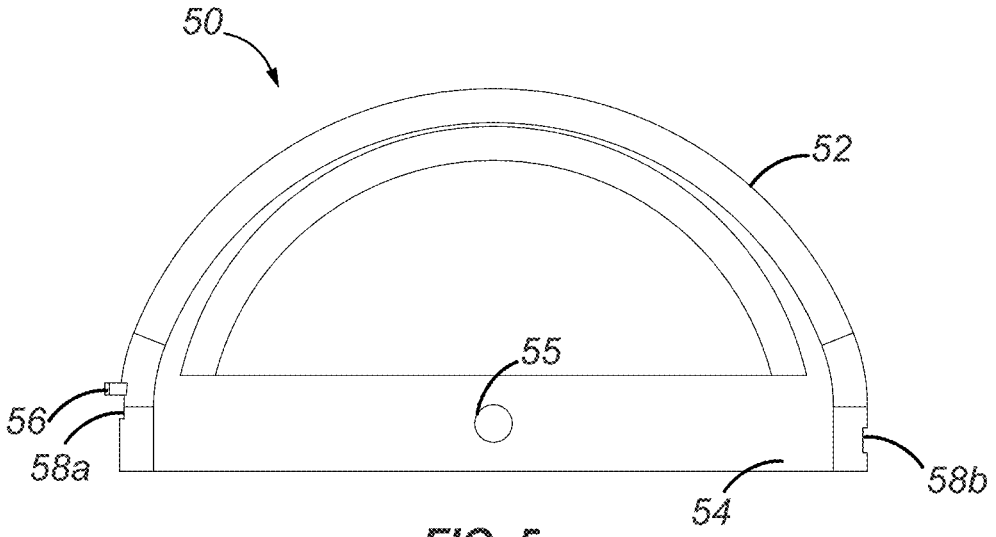
FIG. 5 is a front view of the handle of FIG. 4.
Figure 6A:
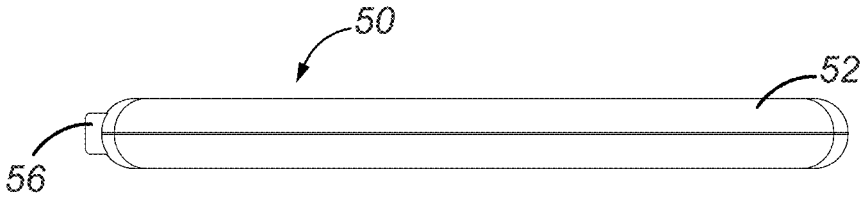
FIG. 6A is a top plan view of the handle of FIG. 4.
Figure 6B:
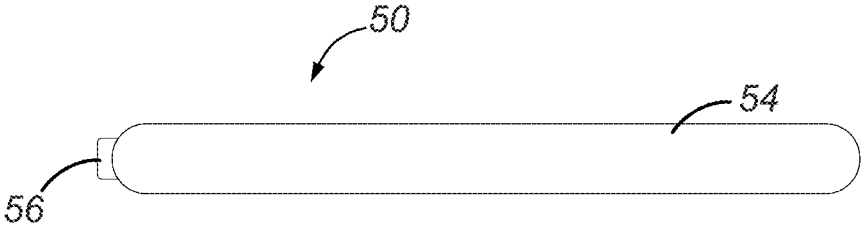
FIG. 6B is a bottom plan view of the handle of FIG. 4.
Figure 7A:
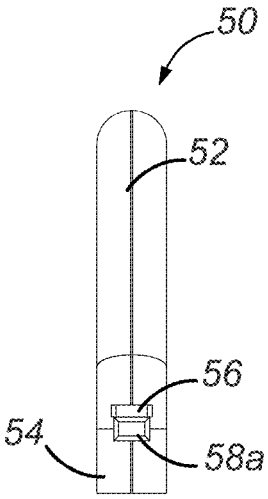
FIG. 7A is a first elevation view of the handle of FIG. 4.
Figure 7B:
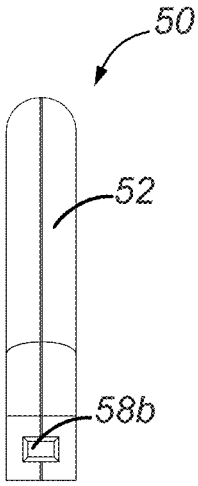
FIG. 7B is a second elevation view of the handle of FIG. 4.

FIG. 4 shows a perspective view of the handle 50. The handle 50 includes a handle grabbing portion 52, a handle base 54, a central pivot pin aperture 55, a catch tab 56, a first lock hole 58*a*, and a second lock hole 58*b*. FIGS. 5, 6A, 6B, 7A, and 7B show further views of the handle 50. Note that a back view of FIG. 5 is a mirror image of the front view shown in FIG. 5, whereas FIGS. 6A, 6B, 7A, and 7B when flipped 180° do not have a mirror image of one another and as such an "A" and a "B" figure are shown for each of these views.

The handle 50 is configured such that the grabbing portion 52 extends outwardly from the handle base 54. The grabbing portion 52 can be generally a U-shape, or otherwise any shape suitable for grabbing. Thus, the grabbing portion of 52 can be ergonomic for a user to grab and stabilize themselves with. As such, the grabbing portion 52 may extend away from the handle base 54 such that there includes a separation or opening between the handle base 54 and the grabbing portion 52.

The handle base 54 may include the central pivot pin aperture 55 such that the central pivot pin aperture 55 is centered within the handle base 54. However, the central pivot pin aperture 55 will not be in a center of the handle base 54 such that it extends in a same direction as the grabbing portion 52, rather the aperture for central pivot pin 55 will extend through the handle base 54 in a direction orthogonal to a direction which the grabbing portion 52 extends from the handle base 54. This will allow for the handle 50 to rotate around the central pivot pin aperture 55 when the handle 50 is positioned within the grab bar assembly 30.

The handle 50 further includes the catch tab 56 to assist with handle 50 operation safety. As will be shown hereafter in later figures the catch tab 56 can make it so the handle 50 only rotates 180° and thus reduce a possibility of a user's hands entering the grab bar assembly 30 in an unexpected or dangerous manner. This does not mean that the catch tab 56 is a necessary component. Rather, the catch tab 56 can improve usability of the grab bar 30. The handle 50 further includes the first lock hole 58*a* and the second lock hole 58*b* positioned such that when the handle 50 rotates around the central pivot pin aperture 55, a bolting mechanism will be able to latch into either of the first lock hole 58*a* or the second lock hole 58*b* depending on whether the grab bar 30 is in the storage configuration or the use configuration.

Figure 8:
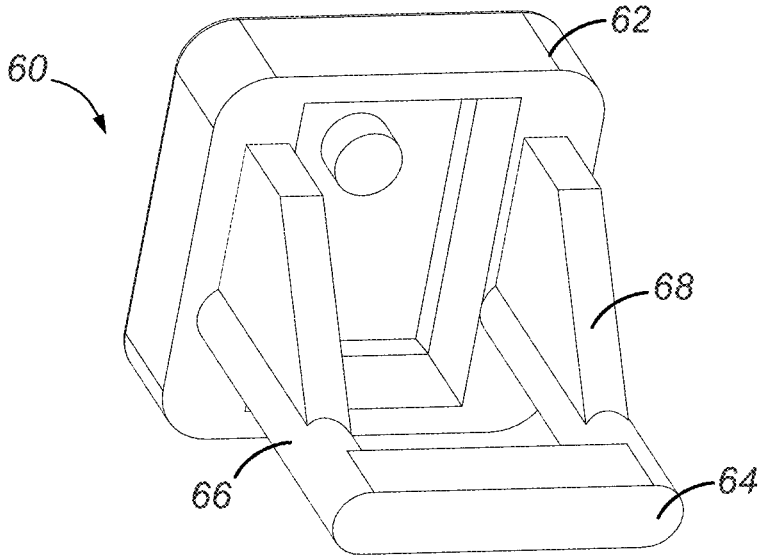
FIG. 8 is a perspective view of a button that is used with the grab bar of FIGS. 3A-3B.
Figure 9A:
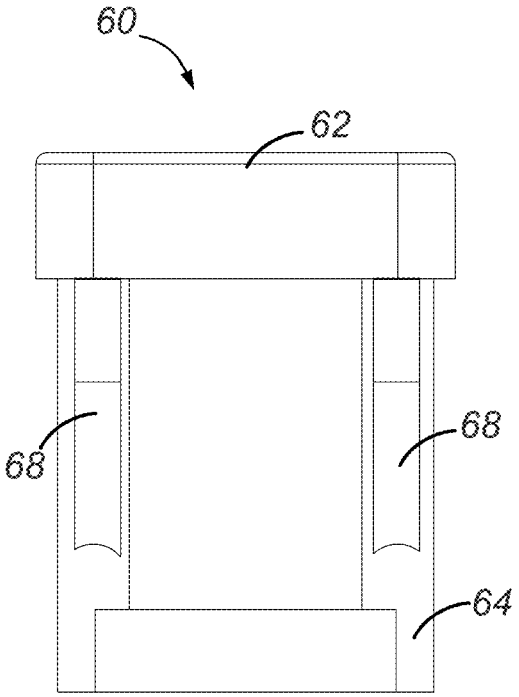
FIG. 9A is a first elevation view of the button of FIG. 8.
Figure 9B:
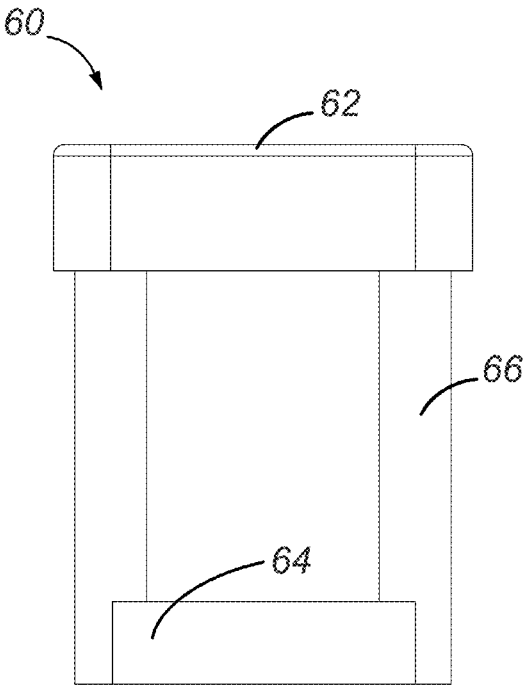
FIG. 9B is a second elevation view of the button of FIG. 8.
Figure 10A:
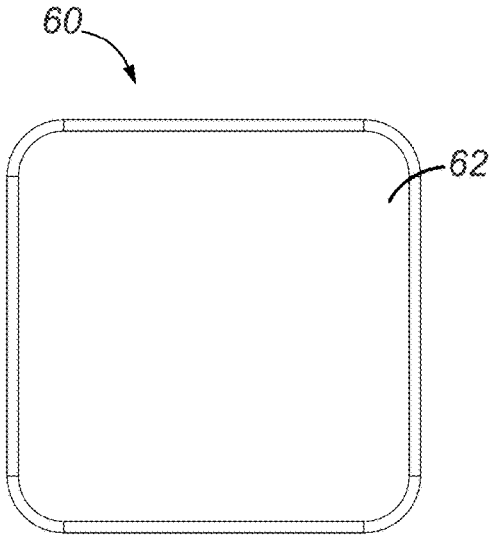
FIG. 10A is a top plan view of the button of FIG. 8.
Figure 10B:
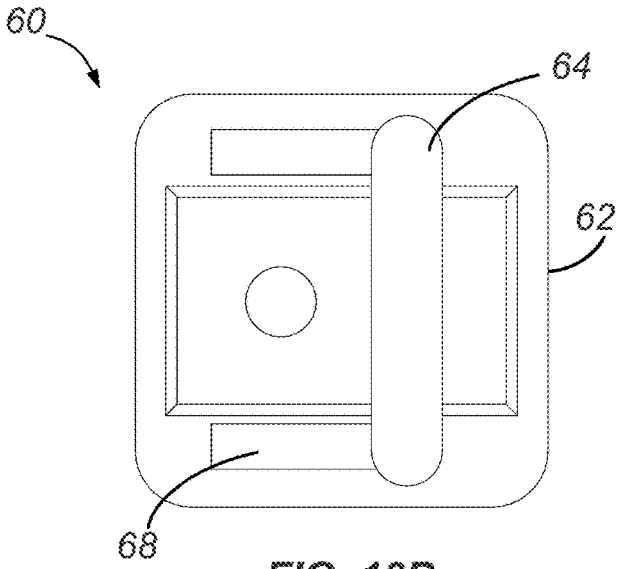
FIG. 10B is a bottom plan view of the button of FIG. 8.
Figure 11A:
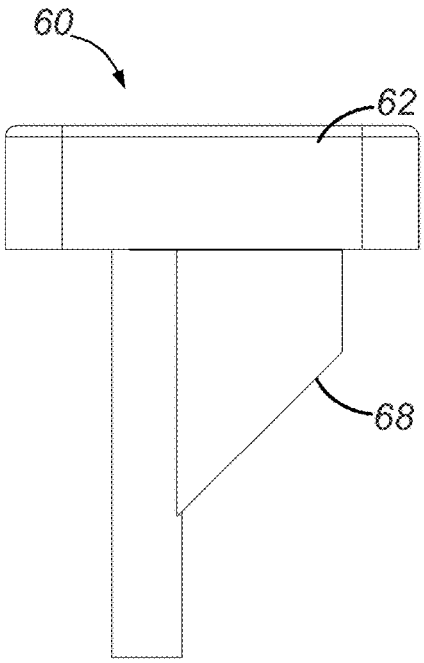
FIG. 11A is a third elevation view of the button of FIG. 8.
Figure 11B:
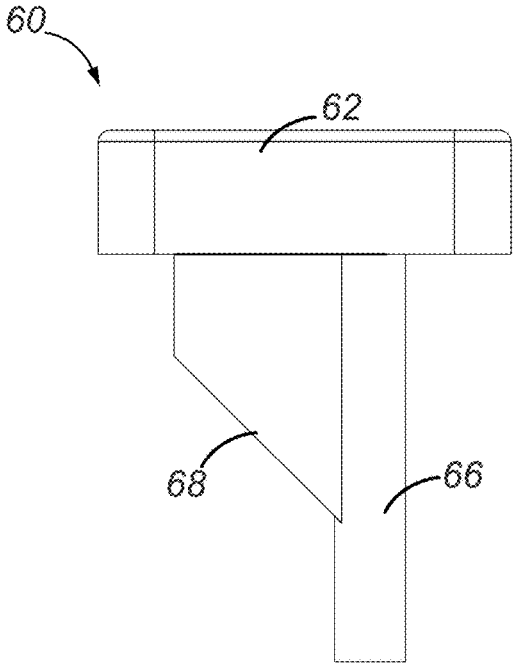
FIG. 11B is a fourth elevation view of the button of FIG. 8.

FIG. 8 shows a perspective view of the button 60. The button 60 includes a button top 62, a button bottom 64, a pair of button columns 66, and a pair of button slides 68. The pair of button columns 66 and the pair of button slides 68 may exist as a single column and/or a single slide rather than each being in a pair. FIGS. 9A, 9B, 10A, 10B, 11A, and 11B show additional views of the button 60.

Generally, the button top 62 is positioned above the pair of button columns 66 which is positioned above the button bottom 64. Further, the pair of button slides 68 generally exist on, and extend outwardly from, the pair of button columns 66. As shown, the button 60 has generally a square shape for the button top 62, however, other user-friendly shapes are possible. The button top 62 is intentionally wider than the button bottom 64 so that an operator who presses the button 60 may be able to access the button 60 with ease. The pair of button slides 68 include a generally sloped or angled shape so as to interact with another component of the grab bar assembly 30 smoothly. This will be described in detail when those figures are discussed. The button bottom 64 can serve as a connection between the pair of columns 66 when the pair of columns 66 exist as a pair rather than existing as a single column 66. Should there exist a single column 66 rather than a pair of button columns 66, the bolt 80 shown hereafter would need to be modified so as to go around the single button column 66 rather than though the pair of button columns 66.

Figure 12:
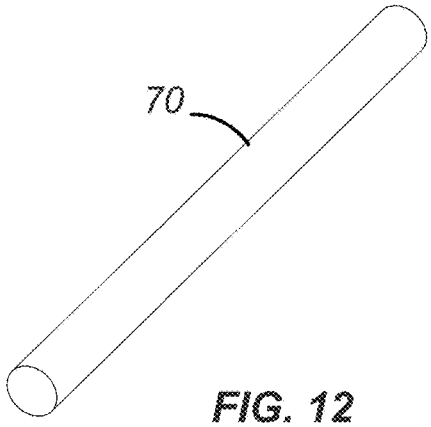
FIG. 12 is a perspective view of a spring pin that is used with the grab bar of FIGS. 3A-3B.
Figure 13:
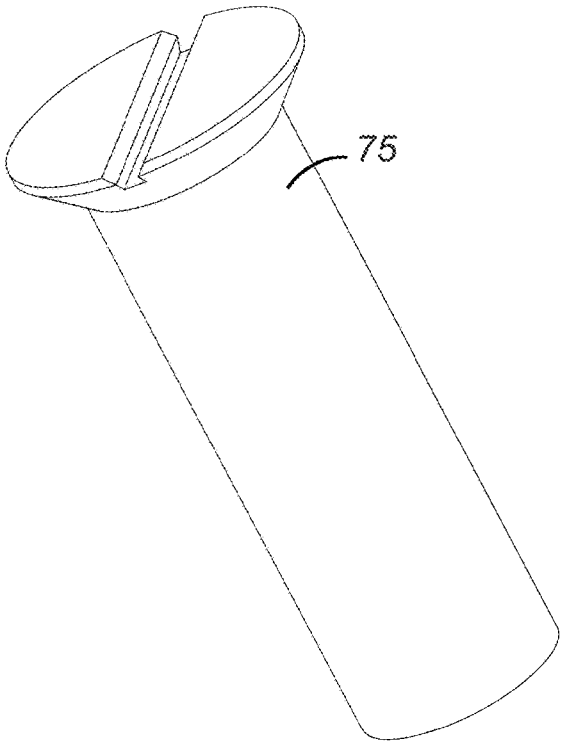
FIG. 13 is a perspective view of a central pivot pin that is used with the grab bar of FIGS. 3A-3B.

FIGS. 12 and 13 show the spring pin 70 and the central pivot pin 75. The spring pin 70 will work in conjunction with the bolt 80 which will be shown hereafter. The central pivot pin 75 need not be a screw, but preferably can be a screw. The central pivot pin 75 need only be a component that functions as a fulcrum for the handle 50 to rotate around, while also maintaining the handle 50 in between a recessed portion of the housing 90.

Figure 14:
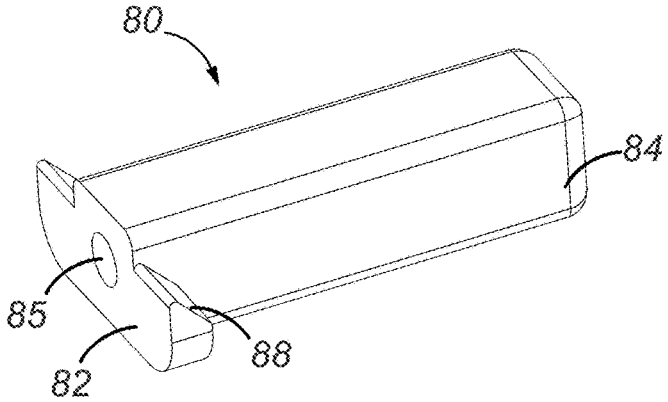
FIG. 14 is a perspective view of a bolt that is used with the grab bar of FIGS. 3A-3B.
Figure 15A:
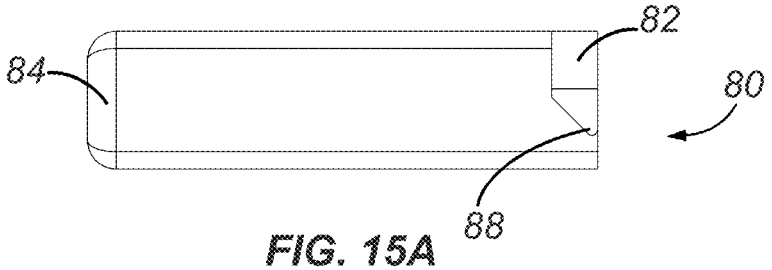
FIG. 15A is a first elevation view of the bolt of FIG. 14.
Figure 15B:
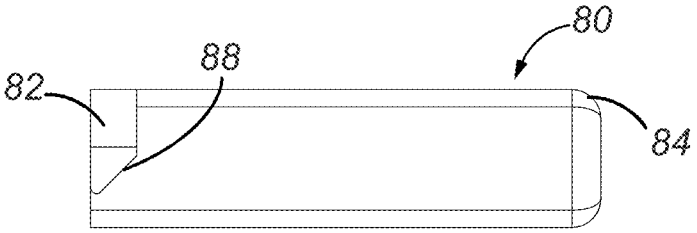
FIG. 15B is a second elevation view of the bolt of FIG. 14.
Figure 16A:
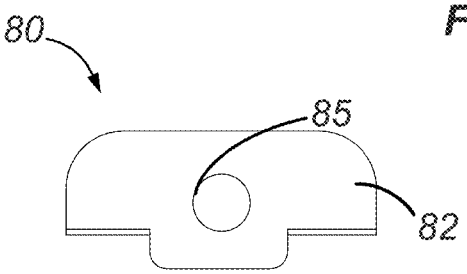
FIG. 16A is a third elevation view of the bolt of FIG. 14.
Figure 16B:
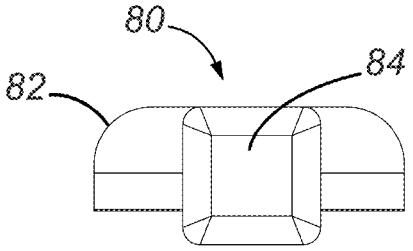
FIG. 16B is a fourth elevation view of the bolt of FIG. 14.
Figure 17A:
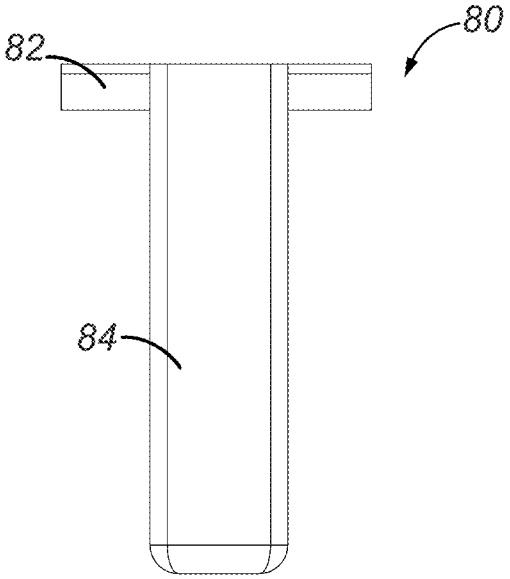
FIG. 17A is a top plan view of the bolt of FIG. 14.
Figure 17B:
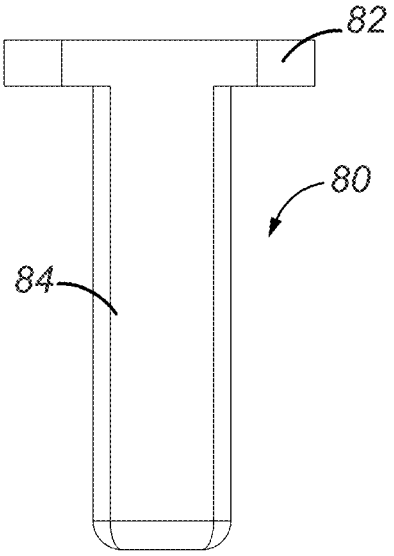
FIG. 17B is a bottom plan view of the bolt of FIG. 14.

FIG. 14 shows a perspective view of the bolt 80. The bolt 80 includes a bolt head 82, a bolt tail 84, a bolt aperture 85, and a pair of bolt slides 88. FIGS. 15A, 15B, 16A, 16B, 17A, and 17B show additional views of the bolt 80.

The bolt 80 is shaped so as to lock within the handle 50 via the bolt tail 84. It is preferable that the bolt tail 84 is thick enough to withstand forces that will be acted on the grab bar by a user such that the bolt 80 will hold the handle 50 in place. The bolt head 82 includes the pair of bolt slides 88 which will interact with the pair of button slides 68 of the button 60. As such, the pair of bolt slides 88 are shaped to interact with the pair of button slides 68, and given that the pair of button slides 68 are generally sloped or angled in shape, it is preferred that the pair of bolt slides 88 are also generally sloped or angled in shape to match the angle thereof. A shape of both the button slide 68 and the bolt slides 88 need not be sloped or angled, rather the shape of the button slide 68 and the bolt slide 88 need only be able to interact with one another such that translational movement of the button 60 in a first direction will result in translational movement of the bolt 80 in a second direction orthogonal to the first direction that need button 60 was moved in.

Figure 18A:
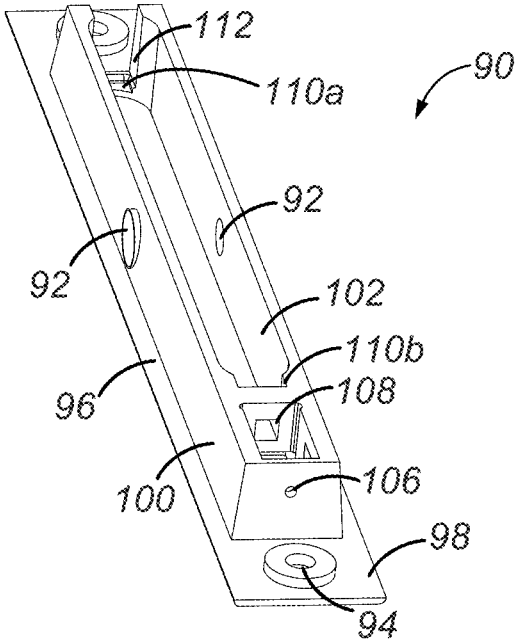
FIG. 18A is a first perspective view of a housing that is used with the grab bar of FIGS. 3A-3B.
Figure 18B:
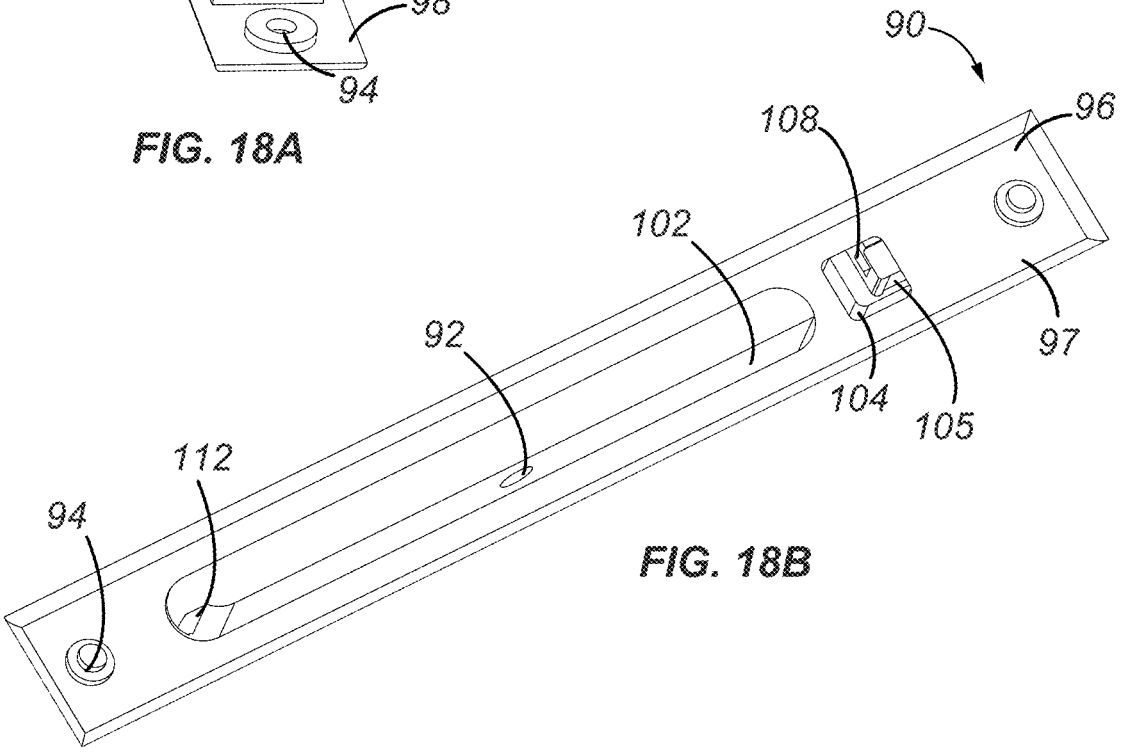
FIG. 18B is a second perspective view of a housing that is used with the grab bar of FIGS. 3A-3B.
Figure 19A:
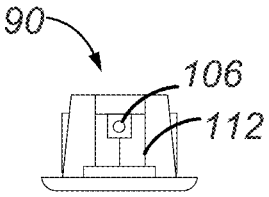
FIG. 19A is a first elevation view of the housing of FIGS. 18A-18B.
Figure 19B:
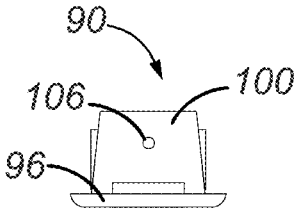
FIG. 19B is a second elevation view of the housing of FIGS. 18A-18B.
Figure 20:
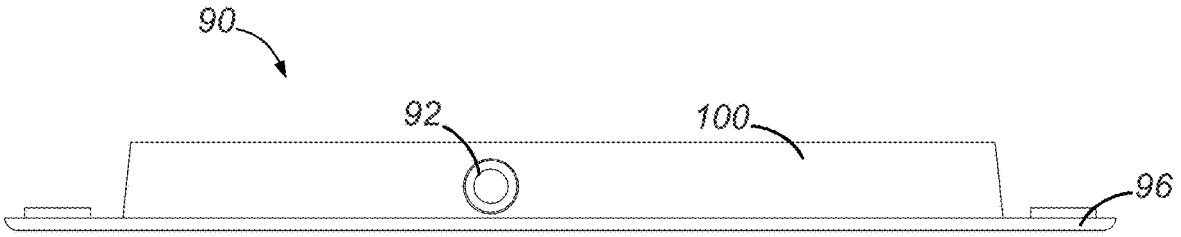
FIG. 20 is a third elevation view of the housing of FIGS. 18A-18B.
Figure 21A:
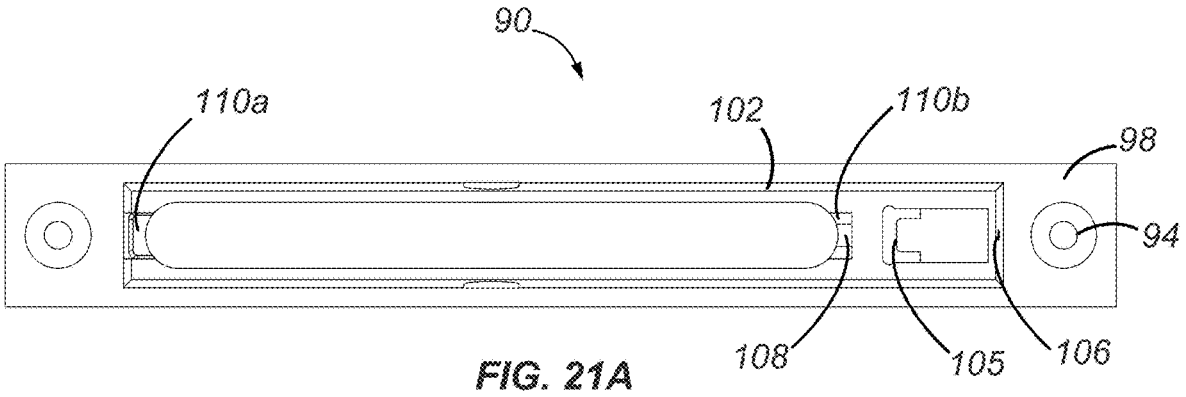
FIG. 21A is a bottom plan view of the housing of FIGS. 18A-18B.
Figure 21B:
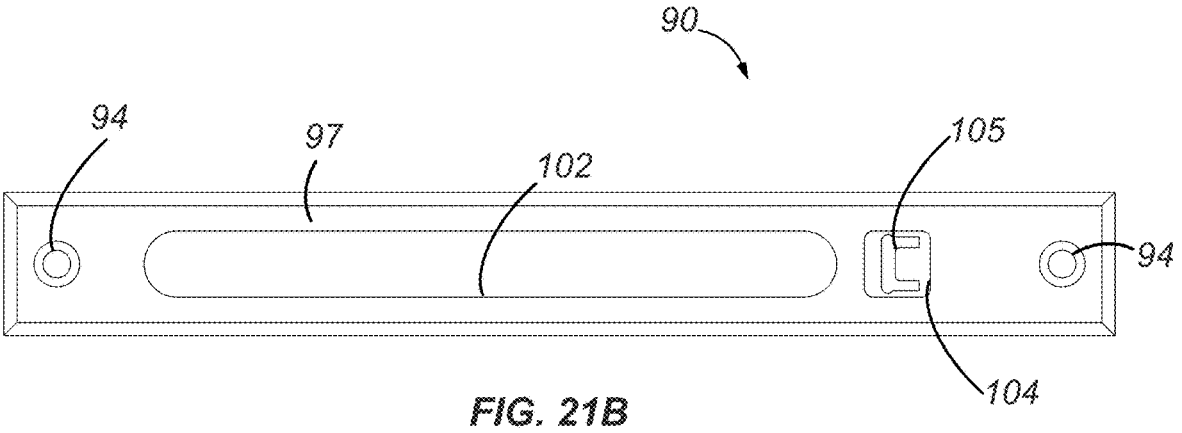
FIG. 21B is a top plan view of the housing of FIGS. 18A-18B.
Figure 22A:
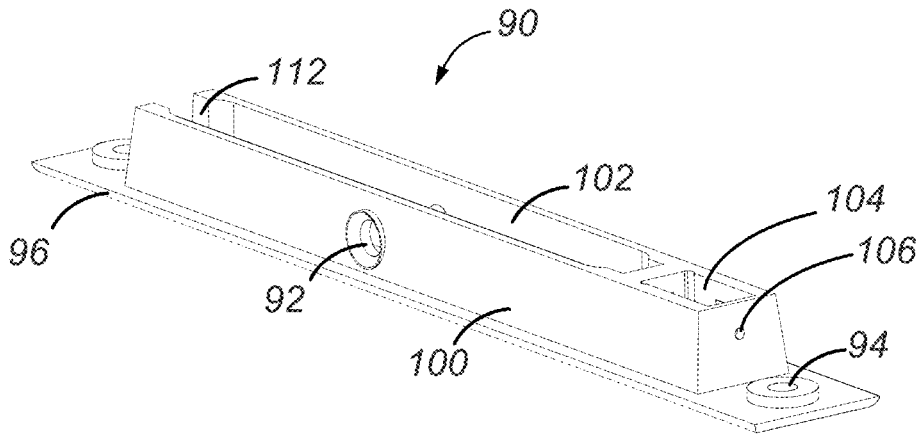
FIG. 22A is another perspective view of the housing of FIGS. 18A-18B.
Figure 22B:
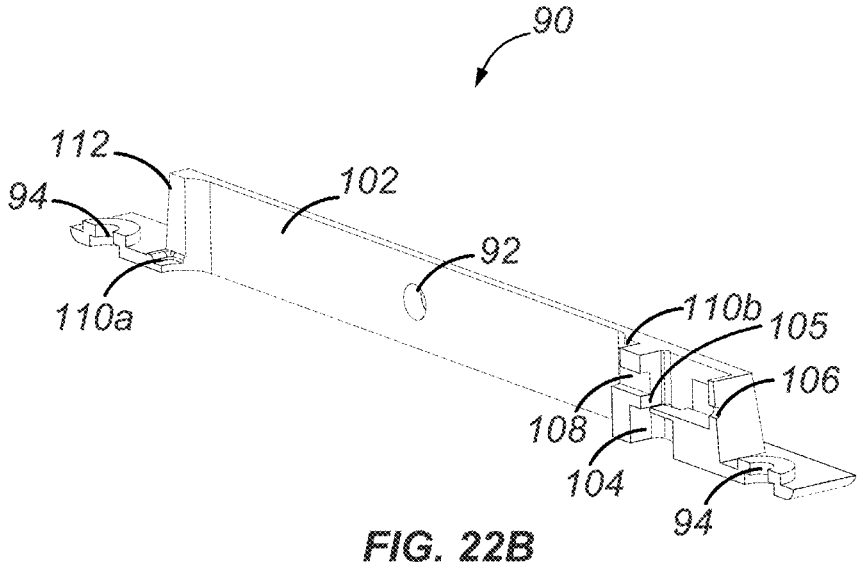
FIG. 22B is a cross-sectional view through a center of the housing shown in FIG. 22A.

FIGS. 18A-18B show perspective views of the housing 90. The housing 90 includes a central pivot pin aperture 92, mounting apertures 94, a flange 96, a viewing side 97, a hidden side 98, a recessed portion 100, a handle aperture 102, a button aperture 104, a fitted button aperture 105, a spring pin aperture 106, a bolt aperture 108, a first catch indent 110*a*, a second catch indent 110*b*, and a canyon 112. FIGS. 19A, 19B, 20, 20A, 21B, 22A, and 22B show additional views of the housing 90. Further, FIG. 22A acts as a reference perspective view for the cross-sectional view shown in FIG. 22B.

The housing 90 is designed to house a rest of the components of the grab bar 30 such that each of the rest of the components interact with the housing 90, or are supported by the housing 90. To aid in housing the components, the housing 90 includes a number of apertures to assist in supporting the components and easing their interacting with one another.

The housing 90 includes the central pivot pin aperture 92 within the recessed portion 100 so as to receive the central pivot pin 75 and act as a fulcrum point for the handle 50 to rotate around. The central pivot pin aperture 92 is intentionally placed at a midpoint between the first catch indent 110*a* and the second catch indent 110*b*. This is so that when the handle 50 is rotated it will allow for the catch tab 56 to secure itself in either of the first catch indent 110*a* or the second catch indent 110*b* to assist the handle 50 in transitioning from the use configuration and the storage configuration.

The housing 90 includes mounting apertures 94 at either end of the housing 90. This is not limiting as to where the mounting apertures 94 are placed, rather, placing them on either end of the housing 90 assists in stability of the housing 90 and ultimately the grab bar 30. The housing 90 may include more than two mounting apertures 94. It is further contemplated that the mounting apertures 94 not be apertures at all, but could also be connection points to connect to a surface via known connecting and/or fastening methods not limited to but given by way of example glues or other adhesives, welding spots, lock-fitting tabs, etc.

The housing 90 further includes the flange 96 extending outwardly which includes the viewing side 97 and the hidden side 98, wherein the viewing side 97 is a side of the housing 90 on which the button 60 will be visible for pressing/operating. When looking down at the viewing side 97, the housing 90 may be 10-20 inches in length and 1-4 inches in width. The viewing side 97 is designed to be aesthetically pleasing while also serving utility purposes such as being substantially flush with a surrounding surface (that the grab bar assembly 30 is mounted to) when the handle 50 is in the storage configuration (thus reducing obstacles that someone could contact should they inadvertently fall), and providing as much grabbing room as possible for the handle 50 when the handle 50 is in the use configuration. The hidden side 98 on the other hand is not viewable when the housing 90 is installed and will include the recessed portion 100 on a same side as the hidden side 98. The recessed portion 100 may house all components except for components used for mounting. This reduces an amount of room or space needed to be removed from a surface which the grab bar 30 may be mounted to by keeping the mounting apertures 94 separate from, rather than included in, the recessed portion 100.

For example, the recessed portion 100 includes the handle aperture 102. The handle aperture 102 is configured to house the handle 50 while allowing room enough for the handle 50 to rotate. The handle aperture 102 may be substantially an oval or stadium shape, or any other shape suitable to a shape of the handle 50. In the figures, the recessed portion 100 only extends so far as to provide a little clearance for both the central pivot pin aperture 92 and the spring pin aperture 106 to not be right at an edge of the recessed portion 100. However, the recessed portion 100 may extend further so as to entirely encompass or surround the handle 50 when the handle 50 rotates into the storage configuration. Benefits exist as to both scenarios. For example, extending the recessed portion 100 so as to fully surround the handle 50 when the handle 50 is rotated into the storage configuration can provide greater protection and longevity of the handle 50, whereas keeping the recessed portion 100 shorter as shown in the figures reduces material costs. As shown in the figures, the handle aperture 102 extends entirely through the housing 90. The handle aperture 102 thus extends through the central pivot pin apertures 92 so as to place the handle 40 therebetween and allow for lateral support of the handle 50 from both sides of the recessed portion 100 with the central pivot pin 75 acting as a load-bearing crossbar supported on either end by the recessed portion 100 with the handle 50 couched therebetween in the housing aperture 102.

The housing 90 further includes the button aperture 104 at a first side of the housing 90 to receive the button 60 and further includes the fitted button aperture 105 so as to guide the button bottom 64 and stabilize the button 60 when pressed. The fitted button aperture 105 may thus assist the button 60 by giving the button 60 stability if the fitted button aperture 105 is shaped the same as a silhouette of, or an exterior shape of, the button 60. Further, the button aperture 104 is conveniently placed near the handle aperture 102 such that the user or operator may conveniently rotate the handle 50 right next to the button 60 when the button 60 is pressed.

Included at a first end of the button aperture 104 is the spring pin aperture 106. The spring pin aperture 106 is sized to surround the spring pin 70. The spring pin aperture 106 may extend through the recessed portion 100 for ease in assembly of the grab bar 30, and for stabilizing (keeping straight) the spring pin 70 as the spring pin 70 will be held in a lateral direction by the spring pin aperture 106, and held in a longitudinal direction between the bolt 80 and a wall which the mounting apertures 94 provide a way of connecting to. The spring pin 70 may assist in biasing the bolt 80 towards the handle 50. As such, included at a second end of the button aperture 104, or an end opposite the first end of the button aperture 104 is the bolt aperture 108. Similar to the spring pin aperture 106, the bolt aperture 108 is sized to allow for its respective component to slide therethrough. The bolt aperture 108 therefore is generally or substantially a same shape as the bolt tail 84 so as to receive the bolt 80 and direct it to the handle 50 where the bolt 80 will be able to engage and lock with the handle 50 when the handle 50 is rotated into either of the use configuration or the storage configuration.

As mentioned earlier, the first catch indent 110*a* and the second catch indent 110*b* exist on opposite sides of the housing 90. Included with the first catch indent 110*a* is the canyon 112. The canyon 112 allows for the catch tab 56 to fully rotate from the use configuration to the storage configuration (and vise versa) without getting caught on the recessed portion 100.

FIGS. 23A, 23B, 23C, 24A, 24B, 25A, 25B, and 26A-C will be discussed together as they each represent different views of the grab bar 30 with all components assembled together. In these figures, the grab bar 30 is in a storage configuration similar to that shown in FIG. 1.

Figure 23A:
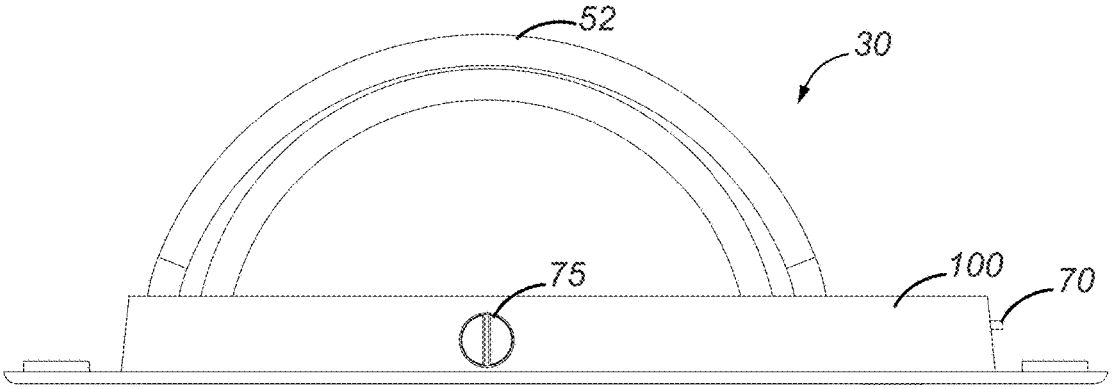
FIG. 23A is a first elevation view of the grab bar.
Figure 23B:
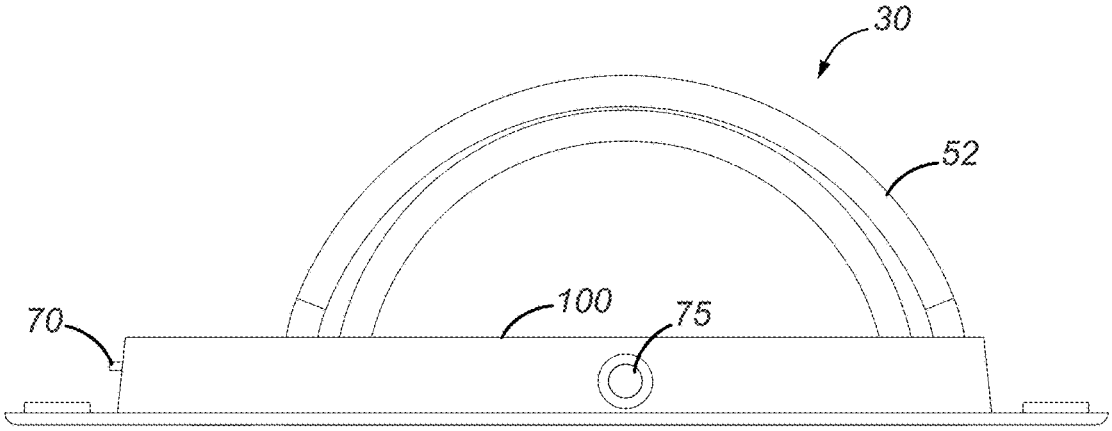
FIG. 23B is a second elevation view the grab bar.

FIGS. 23A and 23B show opposite sides of the grab bar assembly 30. Note how the handle 50 appears off-center in these figures in relation to the mounting apertures on either end of the grab bar 30. However, the handle 50 only appears so because of the button 60 is positioned to a side of the handle 50, and the handle 50 is centered around the central pivot pin 75. Thus, when installing the grab bar assembly 30 it is important to remember to install it such that the handle 50 will be accessible to the user without having to reach an uncomfortable distance. It may be preferable to have the button 60 closer to where a user sits, while on the other hand it may be preferable to have the button 60 farther away such that the button 60 is accessed upon entering the bathtub but the handle 50 remains close to the user so as to adjust a seating position while the user is sitting in the bathtub.

Figure 23C:
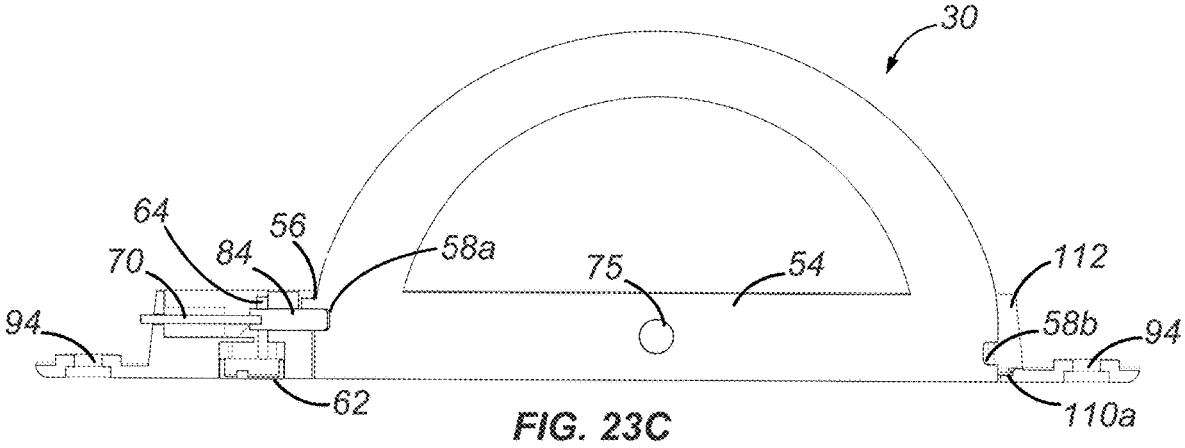
FIG. 23C is a cross-sectional view through a center of the grab bar shown in FIG. 23B.

FIG. 23C shows a mid-center cross-sectional view of the grab bar assembly 30 from the perspective of FIG. 23B. As such, the interaction between the bolt tail 84 and the first lock hole 58*a* can be seen. When the button top 62 is pressed inward it will cause the bolt tail 84 to remove itself from the first lock hole 58*a*, and the handle 50 will then be freely rotatable. Notice that the bolt 80 is not aligned with the central pivot pin 75. As such, this requires that the first lock hole 58*a* and the second lock hole 58*b* be placed equidistant from the central pivot pin 75 in opposite directions. Thus, when the handle 50 rotates into the use configuration, the second lock hole 58*b* will be in alignment with the bolt tail 84 and ready to receive the bolt 80. When the second lock hole 58*b* is on a same side as the second catch indent 110*b* (and thus the first lock hole 58*a* would be on a same side as the first catch indent 110*a*), then the grab bar 30 is in the use configuration.

Note further how distal ends of the handle grab portion 54 are flush with the handle aperture 102 of the recessed portion 100. In this regard, it is helpful to have the canyon 112 so that the catch tab 56 will be allowed to rotate an entire 180-degrees.

Figure 24A:
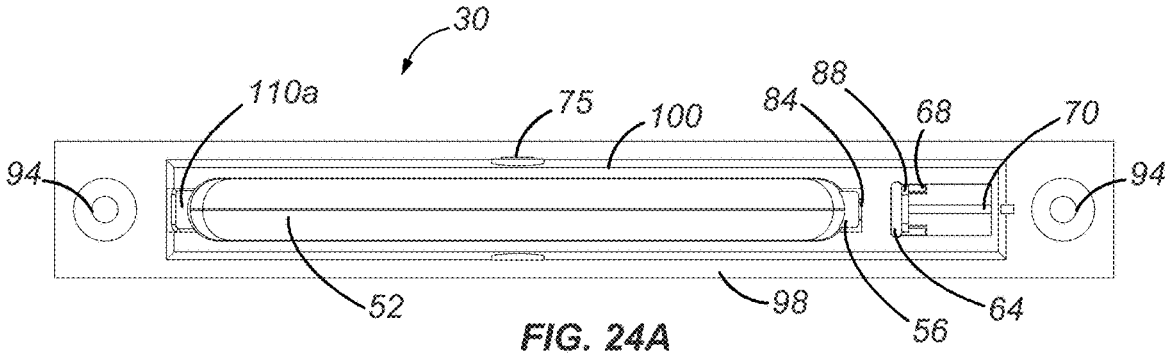
FIG. 24A bottom elevation view of the grab bar.

FIG. 24A provides additional perspective on these elements just discussed and how they interact with another. Namely, note the positioning of the handle grab portion 52 in relation to the first catch portion 110*a*. Note how the catch tab 56 would rotate directly into that first catch portion 110*a* should the handle 50 rotate around the central pivot pin 75. Note further how the bolt slides 88 are visible and placed directly on the button slides 68 and how the bolt tail 84 is visible after passing through the recessed portion 100. The spring pin 70 is assisting in biasing the bolt 80 into the handle 50 when the spring pin 70 is compressed against a wall. Note even further how the button bottom 64 is visible in this figure. This is because the bolt 80 extends through the button 60 and can thus more easily assist in translating a first motion into a second motion orthogonal to the first motion. Shaping the housing 90 and the button 60 such that the bolt 80 extends through the button is a superior design not only for its ease in activating the lock/unlock feature, but also for the bolt's 80 improved stability being surrounded by both the button 60 and a portion of the recessed portion 100.

Figure 24B:
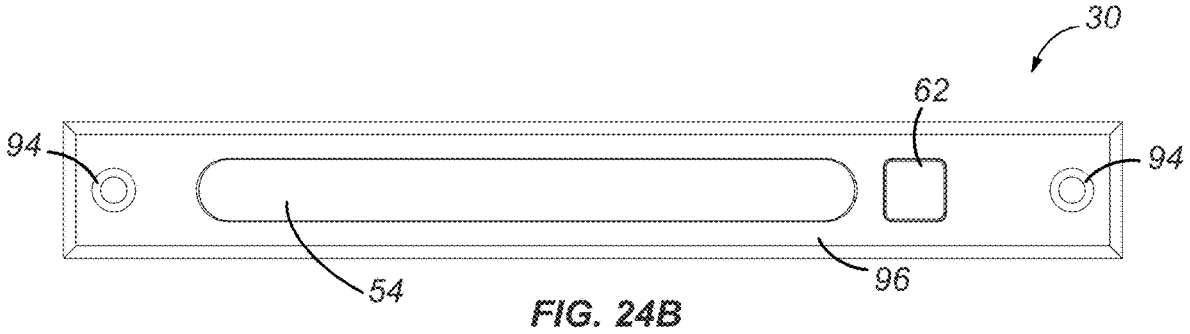
FIG. 24B is a top elevation view of the grab bar.
Figure 25A:
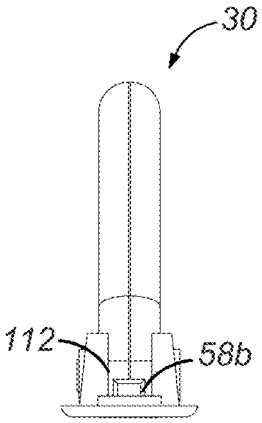
FIG. 25A is a third elevation view of the grab bar.
Figure 25B:
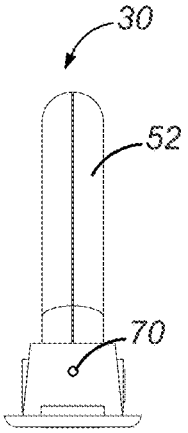
FIG. 25B is a fourth elevation view of the grab bar.

FIG. 24B shows a side of the grab bar 30 which will be visible to the user after installation. The button top 62 provides ease of access to lock and unlock the grab bar 30.

Figure 26A:
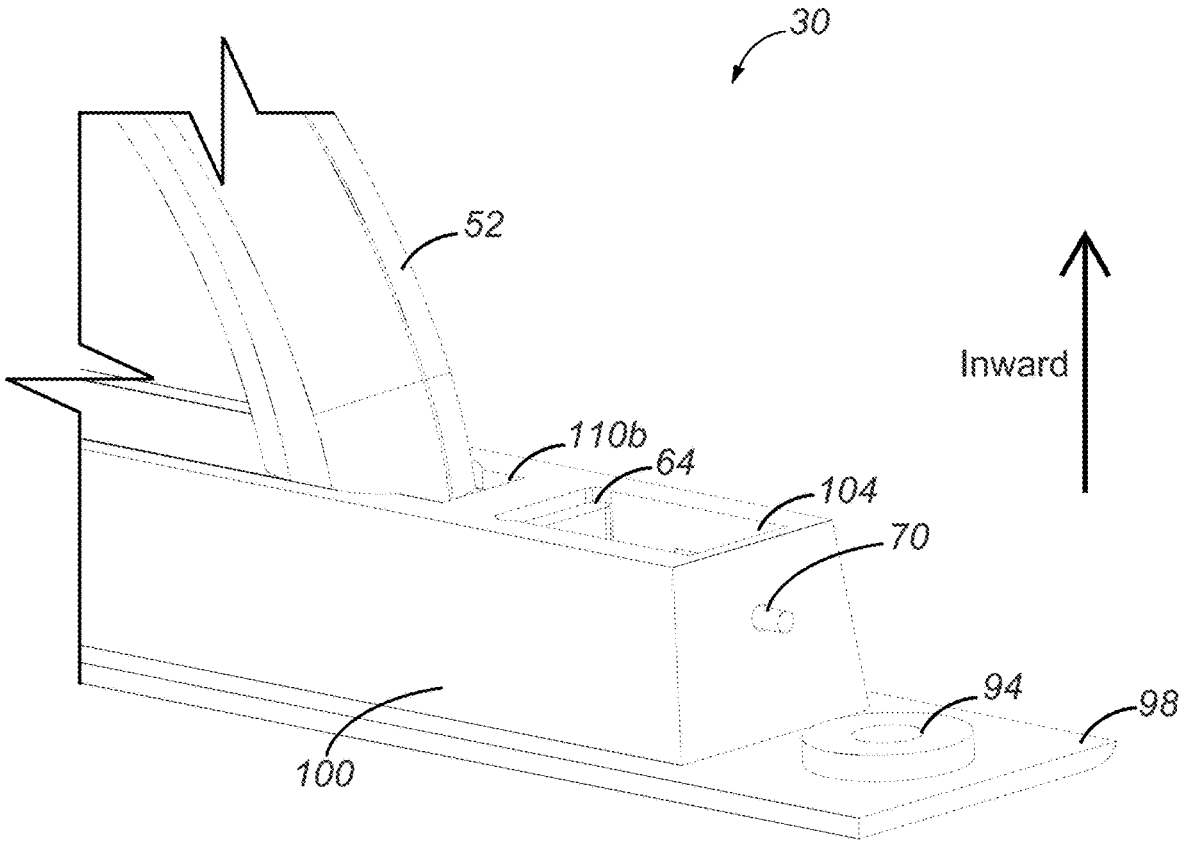
FIG. 26A is a zoomed-in perspective view of the grab bar, emphasizing a locking mechanism which will be used as a reference figure to show varying cross-sectional views in FIGS. 26B and 26C.
Figure 26B:
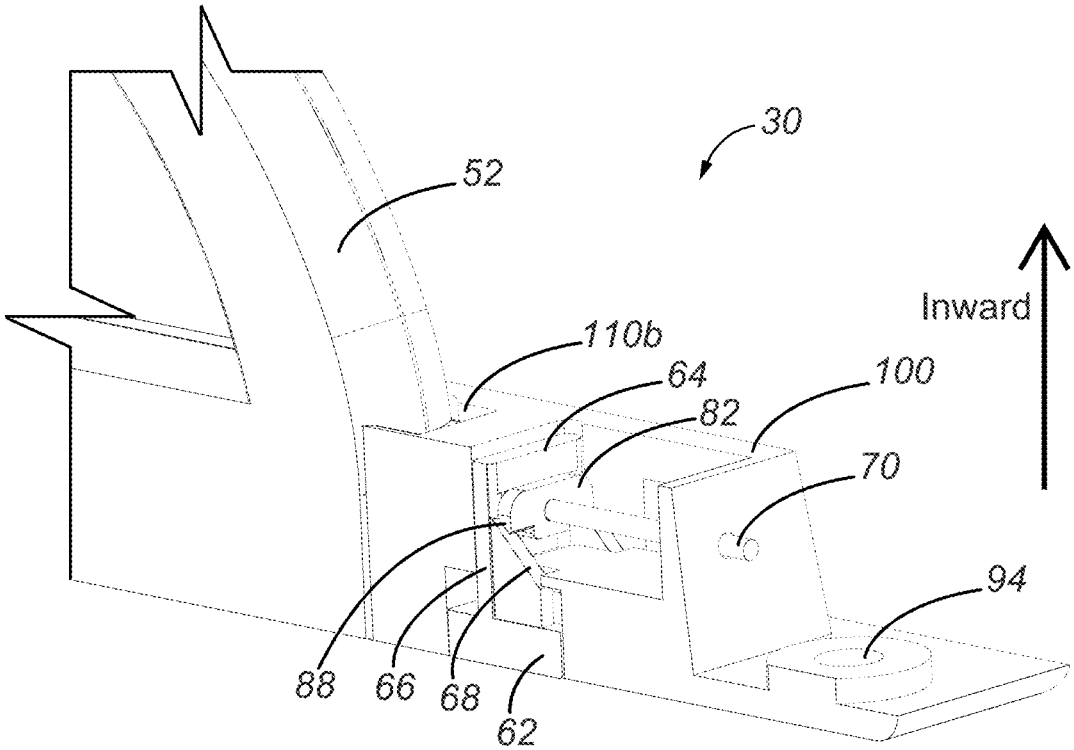
FIG. 26B is a first cross-sectional view of the grab bar of FIG. 26A at a cross-section of about 15% of the way through the grab bar to emphasize components of the locking mechanism.
Figure 26C:
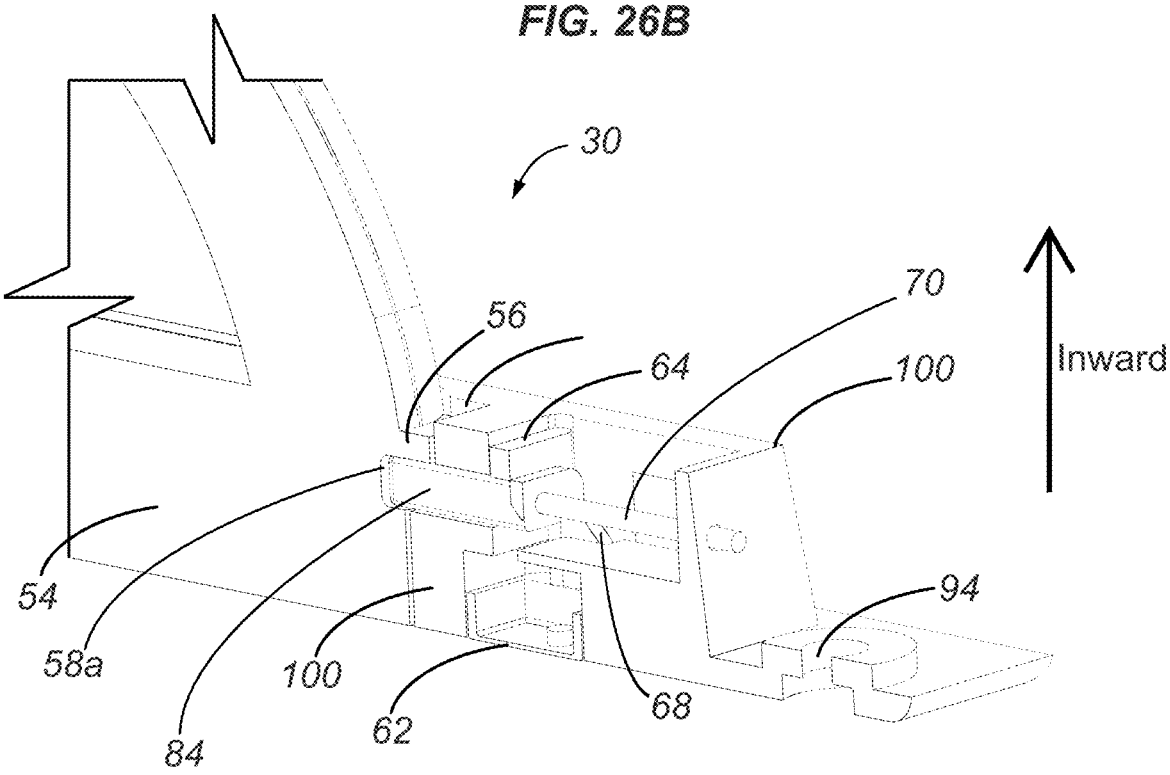
FIG. 26C is a second cross-sectional view of the grab bar of FIG. 26A at a cross-section of about 25% of the way through the grab bar to emphasize components of the locking mechanism.

Finally, FIGS. 26A-26C provide a zoomed-in view of the locking mechanism. FIG. 26A provides a reference figure for both FIG. 26B and FIG. 26C in that the latter are both cross-sectional views of FIG. 26A at varying depths into the grab bar 30.

As shown in these figures, the button top 62 has some room to be pressed inward. When the button 60 is pressed inward, this will force an interaction between the pair of button slides 68 and the pair of bolt slides 88. As the button 60 travels further inward, the bolt head 82 will slide further and further away from the handle 50, thus removing the bolt tail 84 from the first lock hole 58*a* (or the second lock hole 58*b* if the handle 50 is in the use configuration). When the button top 62 is pressed as far inward as it will go, this will place the spring pin 70 at a maximum potential energy so as to urge the pair of bolt slides 88 back along the pair of button slides 68 and towards the handle 50 if a user removes force from pressing the button 60 inward, wherein the button top 62 will be urged back a direction opposite the inward arrow shown from the motion of the bolt 80 towards the handle 50 via the spring pin 70.

It is to be further appreciated that the terms of the application are not to be limiting and all-inclusive. For example, while the terms use and non-use have been used in relation to the grab bars, it is to be appreciated that the bars could be used in their collapsed manner, such as by attaching an anchor, rope, or other device thereto to aid in use of the tether or other device. The bars need not be used in a bathing environment or any other specific environment for that matter.

For example, the grab bar 30 may particularly be associated with any type of seat, including stadium seating, theater seating, boating, automobile seating, airline seating, outdoor seating, classroom seating, hospital seating, or the like. The bars may also act as concealable or retractable handles for movable objects and may be associated with reusable packaging, other moving materials, storage containers, luggage, laundry baskets, or the like.

According to another nonlimiting example, the bars may also act as concealable or retractable handles for substantially movable objects and may be associated with kitchen appliances, grills, doors, or the like.

According to another nonlimiting example, the bars can be used in the fitness industry to facilitate or resist certain types of exercises when mounted on a wall. The grab bars can flip over and be used with bands for stretching. The grab bars may be installed in the floor so that the grab bars may be gripped while a user does push-ups or other types of exercises where you are elevated to work your triceps or biceps.

According to another nonlimiting example, the grab bars can be used in closets at home or can be used in an office setting. The bar of the grab bars may be substituted for hooks and installed in a wall or other surface and when needed can be flipped into the use configuration so that clothes may be hung. When no longer needed, the hooks may be returned to the non-use configuration such that they are concealed and a flush surface is created. The hooks or grab bars may be installed within a concrete, outdoor wall, or other hard surface to create a place to tie a dog leash such that a dog does not have the ability to run away or attack persons passing by.

The bars could also be maintained in their extended configuration even when not in use. Furthermore, it is to be appreciated that additional holding and moving mechanisms could be used to move the bars between a generally extended and retracted or housed position.

From the foregoing, it can be seen that the present invention accomplishes at least all of the stated objectives.

LIST OF REFERENCE CHARACTERS

The following table of reference characters and descriptors are not exhaustive, nor limiting, and include reasonable equivalents. If possible, elements identified by a reference character below and/or those elements which are near ubiquitous within the art can replace or supplement any element identified by another reference character.

TABLE 1: LIST OF REFERENCE CHARACTERS

10 walk-in-bathtub
12 housing
14 door
16 entrance
18 seat
20 interior wall
22 exterior wall
24 access panel
26 access panel
28 top surface
30 grab bar
32 drain
34 floor
50 handle
52 handle grabbing portion
54 handle base
55 central pivot pin aperture
56 catch tab
58*a* first lock hole
58*b* second lock hole
60 button
62 button top
64 button bottom
66 button column
68 button slide
70 spring pin
75 central pivot pin
80 bolt
82 bolt head
84 bolt tail
85 bolt aperture
88 bolt slide
90 housing
92 central pivot pin aperture
94 mounting apertures
96 flange
97 viewing side
98 hidden side
100 recessed portion
102 handle aperture
104 button aperture
105 fitted button aperture
106 spring pin aperture
108 bolt aperture
110*a* first catch indent
110*b* second catch indent
112 canyon

Glossary

Unless defined otherwise, all technical and scientific terms used above have the same meaning as commonly understood by one of ordinary skill in the art to which embodiments of the present disclosure pertain.

The terms "a," "an," and "the" include both singular and plural referents.

The term "or" is synonymous with "and/or" and means any one member or combination of members of a particular list.

As used herein, the term "exemplary" refers to an example, an instance, or an illustration, and does not indicate a most preferred embodiment unless otherwise stated.

The term "about" as used herein refers to slight variations in numerical quantities with respect to any quantifiable variable. Inadvertent error can occur, for example, through use of typical measuring techniques or equipment or from differences in the manufacture, source, or purity of components.

The term "substantially" refers to a great or significant extent. "Substantially" can thus refer to a plurality, majority, and/or a supermajority of said quantifiable variables, given proper context.

The term "generally" encompasses both "about" and "substantially."

The term "configured" describes structure capable of performing a task or adopting a particular configuration. The term "configured" can be used interchangeably with other similar phrases, such as constructed, arranged, adapted, manufactured, and the like.

Terms characterizing sequential order, a position, and/or an orientation are not limiting and are only referenced according to the views presented.

The "invention" is not intended to refer to any single embodiment of the particular invention but encompass all possible embodiments as described in the specification and the claims. The "scope" of the present disclosure is defined by the appended claims, along with the full scope of equivalents to which such claims are entitled. The scope of the disclosure is further qualified as including any possible modification to any of the aspects and/or embodiments disclosed herein which would result in other embodiments, combinations, subcombinations, or the like that would be obvious to those skilled in the art.

What is claimed is:

1. A grab bar assembly, comprising:

a housing including a recessed portion and a flange portion;

a central pivot pin positioned in the recessed portion;

a handle comprising a grabbing portion, a handle base, a first lock hole, and a second lock hole, wherein the handle is rotatable around the central pivot pin between a use configuration and a storage configuration;

a button on the flange portion extending into the recessed portion and positioned on a first side of the handle, the button including a pair of button slides; and a bolt extending through the button, through the recessed portion, and into either of the first lock hole or the second lock hole;

wherein the bolt includes a pair of bolt slides in sliding communication with the pair of button slides so as to be capable of converting a first translational motion into a second translational motion orthogonal to the first translational motion when the pair of button slides interface with the pair of bolt slides.

2. The grab bar assembly of claim 1, wherein the central pivot pin passes through the recessed portion, the handle base, and the recessed portion again.

3. The grab bar assembly of claim 1, wherein an end of the central pivot pin is male-threaded and a central pivot pin aperture receiving the central pivot pin is female-threaded.

4. The grab bar assembly of claim 1, further comprising a spring pin to bias the bolt towards the handle, wherein the spring pin extends through the recessed portion and into the bolt.

5. The grab bar assembly of claim 1, wherein the handle includes a catch tab for preventing the rotatable body support from rotating more than 180°.

6. The grab bar assembly of claim 5, wherein the housing includes a first catch indent positioned at a second side of the handle, wherein the housing includes a second catch indent positioned at the first side of the handle, and wherein when the handle rotates from the use configuration to the storage configuration a first side of the catch tab interfaces with the first catch indent and a second side of the catch tab interfaces with the second catch indent.

7. The grab bar assembly of claim 6, further comprising a canyon in the recessed portion to allow for a full 180° range of motion for the handle.

8. The grab bar assembly of claim 1, wherein the button further includes a button top substantially flush with the flange, a button bottom opposite the button top, and a pair of button columns connecting the button bottom and the button top.

9. The grab bar assembly of claim 8, further comprising a fitted button aperture to receive and stabilize the button bottom.

10. The grab bar assembly of claim 8, wherein the bolt includes a bolt head and a bolt tail opposite the bolt head for inserting into the handle, wherein the bolt head is wider than the bolt tail.

11. The grab bar assembly of claim 10, wherein the bolt tail extends through the pair of button columns, the button top, and the button bottom, but the bolt head cannot extend through the pair of button columns, the button top, and the button bottom.

12. The grab bar assembly of claim 11, wherein the button bottom prevents the button top from extending further than the flange.

13. The grab bar assembly of claim 12, wherein the pair of button slides extend from the pair of button columns.

14. The grab bar assembly of claim 1, wherein the first lock hole and the second lock hole are not aligned across the handle base.

15. The grab bar assembly of claim 1, further comprising mounting apertures positioned at distal ends of the flange.

16. The grab bar assembly of claim 1, wherein the spring pin extends through a button aperture of the grab bar assembly.

17. The grab bar assembly of claim 1, wherein the handle base is substantially flush with the flange when in the storage position.

18. The grab bar assembly of claim 1, wherein the housing provides stability for each of the handle, the button, the bolt, the spring pin, and the central pivot pin.

19. A grab bar assembly built into a surface comprising:

a grab bar housing including a recessed portion and a flange portion;

a central pivot pin positioned in the recessed portion;

a handle comprising a grabbing portion, a handle base, a first lock hole, and a second lock hole, wherein the handle is rotatable around the central pivot pin between a use configuration and a storage configuration;

a button on the flange portion extending into the recessed portion and positioned on a first side of the handle, the button including a button slide; and a bolt extending into either of the first lock hole or the second lock hole, the bolt including a bolt slide for interfacing with the button slide;

wherein in the storage configuration the grabbing portion is concealed within a wall of a structure, said structure being a building, a seat, or an appliance;

wherein the grabbing portion is at or below the surface when in the storage configuration; and wherein the grabbing portion extends outward at least partially from the surface in the use configuration.

20. A method of concealing and revealing a handle, comprising:

housing the handle comprising a grabbing portion, a handle base, and a central pivot pin aperture with a central pivot pin extending therethrough within a housing having a recessed portion and a flange, said recessed portion both receiving and supporting the central pivot pin and said flange extending outwardly of the recessed portion and having a thickness less than a depth of the recessed portion;

allowing the rotatable body support to rotate approximately 180° around the central pivot pin between a use configuration and a storage configuration, wherein in the storage configuration the housing conceals the grabbing portion within a surface of a building, a seat, or an appliance; and pressing a button positioned on the flange to lock or unlock the handle to allow for rotation from the use configuration to the storage configuration;

wherein the grab bar housing is mounted to the building, the seat, or the appliance such that at least a portion of the grab bar housing is flush with the surface.

* * * * *